US005544389A

United States Patent [19]

Onoue et al.

[11] Patent Number: 5,544,389

[45] Date of Patent: Aug. 13, 1996

[54] SLIVER PIECING IN SPINNING MACHINES

[75] Inventors: Keiji Onoue; Yukio Saito; Takashi Imai, all of Kariya, Japan

[73] Assignee: Kabushiki Kaisha Toyoda Jidoshokki Seisakusho, Kariya, Japan

[21] Appl. No.: 189,492

[22] Filed: Jan. 31, 1994

[30] Foreign Application Priority Data

Feb. 10, 1993 [JP] Japan ..... 5-022928

[51] Int. Cl.[6] ..... D01H 15/00

[52] U.S. Cl. ..... 19/157; 57/90

[58] Field of Search ..... 19/144, 150, 157, 19/159 A, 236; 57/281, 90, 276, 277, 266, 268, 269

[56] References Cited

U.S. PATENT DOCUMENTS

| | | | |
|---|---|---|---|
| 4,033,104 | 7/1977 | Kamp | 19/159 A |
| 4,694,539 | 9/1987 | Langen | 19/159 A |
| 4,697,310 | 10/1987 | Raasch | 19/159 A |
| 4,875,256 | 10/1989 | Gunlinger | 19/159 A |
| 4,972,669 | 11/1990 | Raasch | 19/159 A |
| 4,982,563 | 1/1991 | Stanlecker | 19/159 A |
| 4,987,645 | 1/1991 | Kawasaki et al. | 19/159 A |
| 5,263,228 | 11/1993 | Shinkai et al. | 19/159 A |

FOREIGN PATENT DOCUMENTS

| | | |
|---|---|---|
| 3734258 | 4/1989 | Germany . |
| 4216728 | 11/1992 | Germany . |
| 4217561 | 7/1992 | Japan . |

*Primary Examiner*—C. D. Crowder
*Assistant Examiner*—Larry D. Worrell, Jr.
*Attorney, Agent, or Firm*—Brooks Haidt Haffner & Delahunty

[57] ABSTRACT

A sliver piecing machine which can decrease the time of the sliver piecing work and which permits replacement of an empty can row by a full sliver can row between the work of cutting the spun sliver and the subsequent sliver piecing work. The sliver piecing machine is moved along traveling rails placed above the can rows. A housing of the sliver piecing machine has a sliver cutting device and a sliver piecing device which are respectively provided on the front and rear sides in the direction of movement of the sliver piecing machine along the traveling rails. The sliver piecing machine performs only the sliver cutting work in the forward movement thereof, and only the sliver piecing work in the backward movement. After the sliver cutting work, the empty can row is replaced by the full can row, and the sliver piecing work is then performed.

17 Claims, 30 Drawing Sheets

SLIVER PIECING IN SPINNING MACHINES

BACKGROUND OF THE INVENTION

1. Field of the Invention

The present invention relates to a sliver piecing method, a sliver piecing machine and a sliver piecing system in a spinning machine such as a roving frame, a drawing frame or the like.

2. Description of the Related Art

Various kinds of automation have recently been made for saving human labor and improving productivity in a spinning mill, and automation of the sliver piecing work in a spinning machine such as a roving frame, a drawing frame or the like has also been proposed (for example, see Japanese Patent Laid-Open No. 2-91233). In this case, as shown in FIG. 44, cans 202 containing sliver S under spinning, and full sliver cans 203 in reserve containing sliver S to be newly supplied are disposed adjacent to each other in plural rows along the lengthwise direction (the direction vertical to the drawing of FIG. 44) of a roving frame 201. A silver piecing machine 204 is moved on traveling rails 206 which are extended along the can rows above feed rollers 205 for guiding the sliver S to the roving frame 201. The feed rollers 205 are respectively disposed opposite to the centers of the cans 202 and 203 above the can rows along the lengthwise direction of the roving frame 201. The sliver piecing machine 204 is provided with an arm 208 having a sliver holding unit 207 and a silver piecing unit 209. The arm 208 is formed so as to be extension and horizontally movable in the direction vertical to the feel rollers 205.

In the sliver piecing work, the sliver S which is being spun and which is continued from the roving frame 201 is introduced into the introduction portion of the sliver piecing unit 209 and is held by the silver piecing unit 209. In spinning, the sliver S is introduced into the introduction portion of the sliver piecing unit 209 by a sliver taking-in arm (not shown) provided on the sliver piecing unit 209. The sliver holding unit 207 then holds the sliver S on the upstream side of the sliver piecing unit 209 (on the side of the cans), and is moved in the direction away from the sliver piecing unit 209 to cut the silver S. The sliver holding unit 207 then holds the end of the sliver S contained in the full sliver can 203 and introduces the end into the introduction portion of the sliver piecing unit 209 so as to overlap the introduced end and the end of the cut sliver held by the sliver piecing unit 209. In the state wherein the overlapped portions of both slivers S are held, the sliver holding unit 207 is then moved in the direction away from the sliver piecing unit 209 to cut the new sliver S. The slivers are then pieced together by operation of the sliver piecing unit 209. Namely, in the sliver piecing machine 204, the sliver S is introduced into the introduction portion of the sliver piecing unit 209 in the state wherein the sliver S is horizontally extended. In addition, the arm 208 is moved above the feed rollers 205 so as to cut the sliver S and introduce the sliver S into the introduction portion of the sliver piecing unit 209.

Japanese Patent Laid-Open No. 2-91233 also discloses a sliver piecing method of piecing slivers S which are vertically extended. In this method, a single feed roller 205 is provided for a row of cans 202 and a row of full sliver cans 203, and a guide 210 is disposed opposite to the boundary between both can rows, as shown in FIG. 45. A sliver piecing machine 211 which is moved on traveling rails 206 disposed under the feed rollers 205 comprises an arm 212 having a sliver holding unit (not shown) and provided at the end thereof. The arm 212 is rotated in a plane vertical to the direction of movement of the sliver piecing machine 211 so that the sliver holding unit is moved to a position opposite to the upper portion of the sliver piecing unit (not shown) provided on the upper portion of the front of the sliver piecing machine 211 and the end of the sliver S contained in each of the cans 203. In spinning, the sliver S is introduced into the introduction portion of the sliver piecing unit by a sliver taking-in arm (not shown) provided on the sliver piecing unit.

In the piecing method in which the feed roller 205 is provided for each can row, it is necessary for working to move the arm 208, above the feed rollers 205, for a distance about twice the diameter of each can in the direction vertical to the feed rollers 205. As a result, the size of the sliver piecing machine is increased. In addition, since the sliver S which is being spun is cut by the arm 208 in the state wherein the sliver S is introduced into the introduction portion of the sliver piecing unit 209, and the silver S to be newly supplied is also introduced into the introduction portion by the same arm 208, the sliver piecing work requires much time, coupled with a long moving distance of the arm 208.

On the other hand, in the latter method disclosed in Japanese Patent Laid-Open No. 2-91233, the moving distance of the arm 212 is shorter than that in the former method. However, both methods are the same in the point that the sliver S under spinning is cut by the arm 212 in the state wherein the sliver S is introduced into the introduction portion of the sliver piecing unit, and the sliver S to be newly supplied is also introduced by the same arm 212. Thus, the time required for piecing the slivers together cannot be reduced by concurrently performing the work of cutting the sliver S under spinning and the work of introducing the sliver S to be newly supplied into the introduction portion.

In addition, in this sliver piecing method, the sliver S which is being spun out must be introduced into the introduction portion of the sliver piecing unit 209 between the guides 210 and the cans 202. The movement path of the sliver piecing machine 211 cannot be set so that the sliver piecing unit 209 is close to the sliver S under spinning. It is thus necessary for introducing the sliver S under spinning into the introduction portion of the sliver piecing unit 209 to hold the sliver S by the sliver taking-in arm after guiding the sliver S to a portion near the introduction portion. On the other hand, the sliver S under spinning is obliquely drawn out toward the guide 210 from any desired position in the corresponding can 202 near the periphery thereof. As a result, the position of the sliver S extended from the guide 210 to the can 202 is unfixed excepting a portion downwardly extended by its own weight near the guide 210.

The feed rollers 205 for guiding the supplied sliver to a spinning machine cannot be set at a very height in view of the case in which the sliver S must be manually placed on the feed rollers 205 when the kind of the sliver S is exchanged or the sliver S is cut by a cause of some kind during spinning. If the height of the feed rollers 205 is about 180 cm, and the height of the cans 202 is about 100 cm, the difference between the heights of the feed rollers 205 and the upper ends of the cans 202 is about 80 cm. In each of the cans 202, the bottom on which the sliver is placed is generally upwardly urged by a spring, and is lifted with decreases in the amount of the sliver contained therein. When each can is substantially emptied, the upper end of the sliver is kept at substantially the same height as the upper end of the can. Since the sliver piecing machine 211 is moved under the feed rollers 205, the distance between the guides 210 provided on the traveling rails 206 and the upper ends of the cans is smaller than 80 cm. The portion of the sliver S downwardly extended by its own weight near each of the guides 210 is thus shortened.

When the sliver S is guided to a portion near the introduction portion, it is necessary not to pull a portion of the sliver S on the downstream side (on the side of the roving frame) of a position where the sliver S is held or engaged. The sliver S must thus be held or engaged at a position near the can 202 at a distance from the guide 210 and guided to a position near the introduction portion. However, since the position of the sliver S is unfixed at a position near the cans 202, as described above, there are the problems that a sensor for detecting the position of the sliver S is required, and the mechanism and control for moving a holding or unit to the position near the cans 202 are complicated and require much time. Further, the range of movement of the holding or engaging unit must be widened, thereby causing the problem of increasing the size of the entire apparatus.

A full sliver can row in reserve is disposed adjacent to each of the sliver can rows under spinning so that the empty can (the can from which the sliver has been completely supplied) need not be moved in the process of piecing slivers. On the other hand, the sliver piecing work is performed in the state where the operation of the roving frame is stopped. The size of each sliver can is generally increased for increasing the operation efficiency of the roving frame by increasing the period of the sliver piecing work. As a result, in the roving machine, since the sliver cans under spinning cannot be arranged in a row corresponding to each of weights, sliver cans are arranged in plural rows behind the robing frame base. The sliver cans are sometimes in three or four rows. However, when the sliver cans under spinning are arranged in plural rows, if the conventional sliver piecing method is employed, plural rows of full sliver cans in reverse must be arranged corresponding to the rows of the sliver cans under spinning. As a result, a large area is required for arranging the cans, and the sliver spun out from the cans arranged in the last row might be irregularly drafted in the course of spinning because the sliver is supplied to the roving frame at a long distance therefrom.

In general, plural rows of sliver cans under spinning are thus arranged near the roving frame, and rows of full sliver cans in reserve are arranged behind them. In this arrangement of the sliver can rows, after the sliver S under spinning is cut, the sliver cannot be pieced with another sliver until the can row of the cut sliver S is replaced by the full sliver can row. It is thus impossible to employ the conventional sliver piecing method in which the sliver S under spinning is cut in the introduction portion of the sliver piecing unit, and the cut end must be held at the position.

SUMMARY OF THE INVENTION

The present invention has been achieved in consideration of the above problems, and a first object of the invention is to provide a sliver piecing method, a sliver piecing machine and a sliver piecing system which can decrease the working time for a first can row from cutting of a spun sliver to be pieced with another sliver to completion of the sliver piecing work.

A second object of the invention is to provide a sliver piecing method, a sliver piecing machine and a sliver piecing system which permits automation of a sliver piecing method in which a sliver row from which the sliver was supplied is replaced by a full sliver row after the spun sliver to be pieced with another sliver is cut, and the sliver piecing work is then performed.

In order to achieve the two objects, in accordance with a first embodiment of the present invention, a sliver piecing method comprises piecing slivers together by an automatic machine which is moved along a row of cans for supplying a silver and which is equipped with a sliver piecing unit, wherein after the spun sliver to be pieced with another sliver is cut so that the end of the sliver is freely suspended, the sliver is pieced with a sliver of a sliver can containing a sliver to be newly supplied.

In order to achieve the two objects, in accordance with a second embodiment of the present invention, a sliver piecing method comprises piecing slivers together by an automatic machine which is moved along a row of cans for supplying a sliver and which is equipped with a sliver piecing unit, wherein the spun sliver to be pieced with another sliver is cut during the forward movement of the automatic machine from the first end side of the can row to the second end side thereof, and the cut sliver and a sliver of a sliver can containing a sliver to be newly supplied are pieced together during the backward movement of the automatic machine from the second end side to the first end side of the can row.

In order to achieve the first object, in accordance with a third embodiment of the present invention, a sliver piecing method comprises piecing slivers together by an automatic machine which is moved along a can row for supplying a sliver, wherein a sliver can under spinning and a reserve sliver can are arranged in parallel, the spun sliver to be pieced with another sliver is cut by a sliver cutting unit provided on the front side in the moving direction of the automatic machine, and the cut sliver and the sliver of the reserve sliver can are pieced together by a sliver piecing unit provided on the rear side in the moving direction of the automatic machine.

In order to achieve the two objects, a fourth embodiment of the present invention comprises a sliver cutting unit for cutting a spun sliver to be pieced with another sliver, and a sliver piecing unit for piecing the cut sliver and a sliver of a sliver can containing a sliver to be newly supplied, wherein the sliver cutting unit and the sliver piecing unit are respectively disposed at front and rear positions in the moving direction of the sliver piecing unit along a row of cans for supplying a sliver.

In order to achieve the two objects, a fifth embodiment of the present invention comprises a movement path provided along a row of cans for supplying a sliver to a spinning machine, a sliver cutting machine moved on the movement path and provided with a sliver cutting unit for cutting the spun sliver to be pieced with another sliver, and a sliver piecing machine moved along the movement path and provided with a sliver piecing unit for piecing the cut sliver and a sliver of a sliver can containing a sliver to be newly supplied.

In the method in accordance with the first embodiment of the present invention, the Sliver piecing work is performed by the automatic machine which is moved along the row of cans for supplying a sliver. The spun sliver (referred to as "old sliver" hereinafter) to be pieced with another sliver is first cut by the automatic machine so that the silver end is freely suspended. The cut old sliver and a sliver (referred to as "new sliver" hereinafter) of a sliver can containing a sliver to be newly supplied are then pieced together. Although the position of the old sliver between feed rollers and the cans is unfixed in the state where the old sliver is joined to the sliver in a can, the position of the old sliver is constant in the state where the end of the sliver is freely suspended. Thus, the old sliver can easily be introduced into the sliver piecing unit.

In the method in accordance with the second embodiment of the present invention, the sliver piecing work is performed by the automatic machine which is moved along the row of the cans for supplying a sliver. The old sliver is cut in the forward movement of the automatic machine from the first end side of the can row to the second end side thereof. The cut old sliver and the new sliver are pieced together during the backward movement of the automatic machine from the second end side of the can row to the first end side thereof.

In the third embodiment of the present invention, the sliver piecing work is performed by the automatic machine which is moved along the row of cans for supplying a sliver. The work is performed in the state wherein the row of cans containing the old sliver and the row of cans containing the new sliver are arranged in parallel. The old sliver is cut by the sliver cutting unit provided on the front side of the automatic machine in the moving direction thereof, and the cut old sliver and the new sliver are pieced together by the sliver piecing unit provided on the rear side of the automatic machine in the moving direction thereof. In the sliver piecing machine in accordance with the fourth embodiment of the present invention, the sliver cutting unit for cutting the old sliver and the sliver piecing unit for piecing the cut old sliver and the new sliver are independently operated. In the sliver piecing method in which the cans of the old sliver are replaced by the cans of the new sliver after the old slivers are cut, the old sliver is cut by the sliver cutting unit during the forward movement of the sliver piecing machine along the can rows, and the old sliver and the new sliver are pieced together by the sliver piecing unit during the backward movement. When both slivers are pieced together in the state wherein the row of the cans for the old sliver and the row of the cans for the new sliver are arranged in parallel, the old sliver may be cut during the forward movement, and the slivers may be pieced together during the backward movement, as described above. Alternatively, the sliver cutting work and sliver piecing work may be continuously carried out for each of the cans.

In the fifth embodiment of the present invention, the sliver cutting machine and the sliver piecing machine are moved on the movement path provided along the rows of the cans for supplying a sliver to a spinning machine. The old sliver is cut by the sliver cutting unit provided on the sliver cutting machine. The cut old sliver and the new sliver are pieced together by the sliver piecing unit provided on the sliver piecing machine.

DESCRIPTION OF THE EMBODIMENTS

Embodiment 1

A description will be made, with reference to FIGS. 1 to 32, of a first embodiment in which the present invention is applied to a sliver piecing method for a roving frame when cans are automatically conveyed between a drawing process and a roving process both of which are connected by a can conveyance path.

Figure 1:
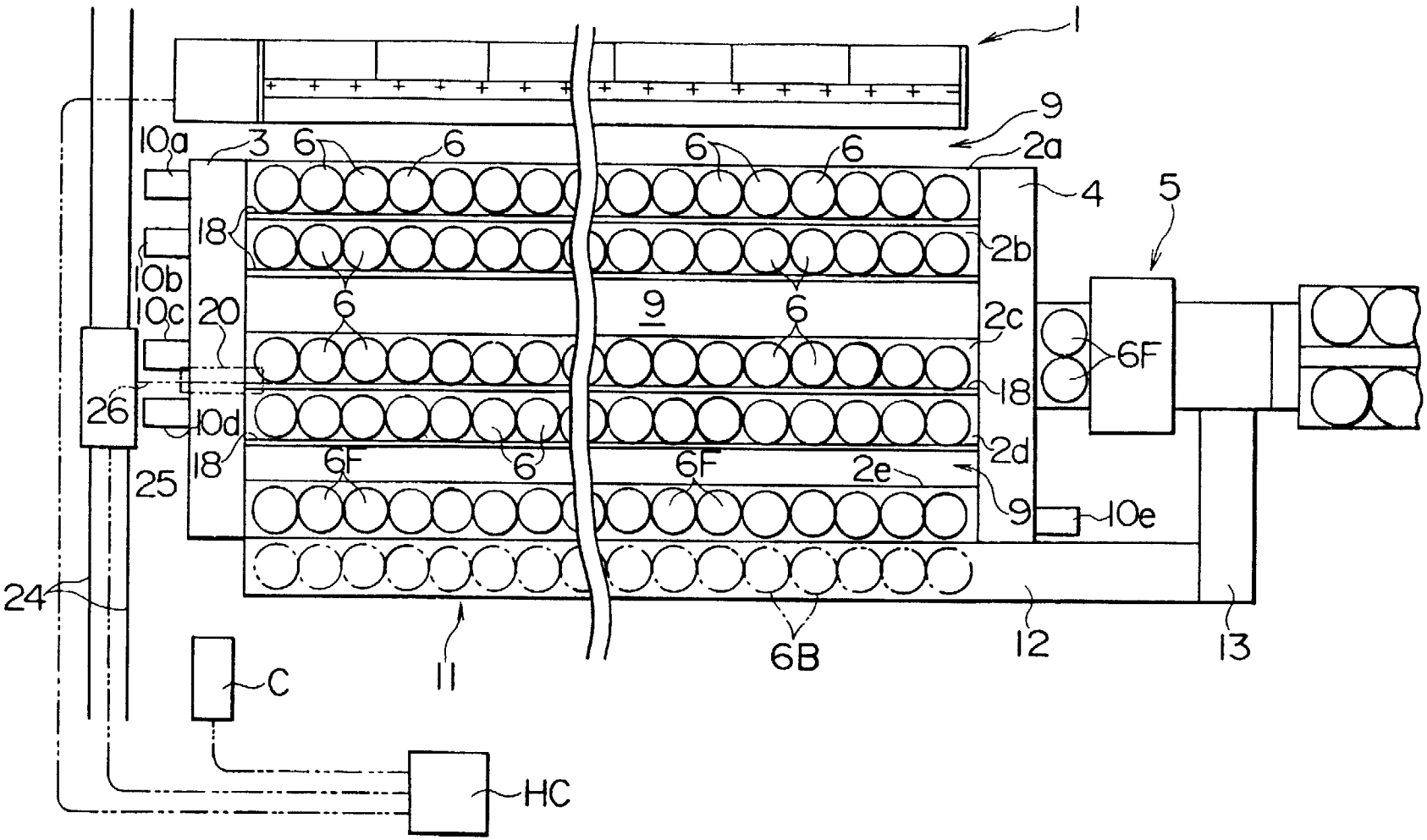
FIG. 1 is a schematic plan view illustrating relations among a roving frame, a traveling rail, can rows, a sliver piecing machine, etc. in accordance with a first embodiment of the present invention.

Referring to FIG. 1, can conveyance units 2*a* to 2*e* each having substantially the same length as that of a roving frame 1 are provided in a plurality of rows (in this embodiment, 5 rows) in parallel with the lengthwise direction of the roving frame 1 behind (in a lower portion of FIG. 1) the roving frame 1. Can conveyance units 3 and 4 are disposed at right angles with the can conveyance units 2*a* to 2*e* on the first end side (the left of FIG. 1) and the second end side (the right of FIG. 1), respectively, of the can conveyance units 2*a* to 2*e* so as to connect the can conveyance units 2*a* to 2*e*. A drawing frame 5 is disposed opposite to the can conveyance unit 4 so that full sliver cans 6F containing a sliver produced in the drawing frame 5 are pushed out onto the can conveyance unit 4 by the operation of a push unit (not shown).

Figure 5:
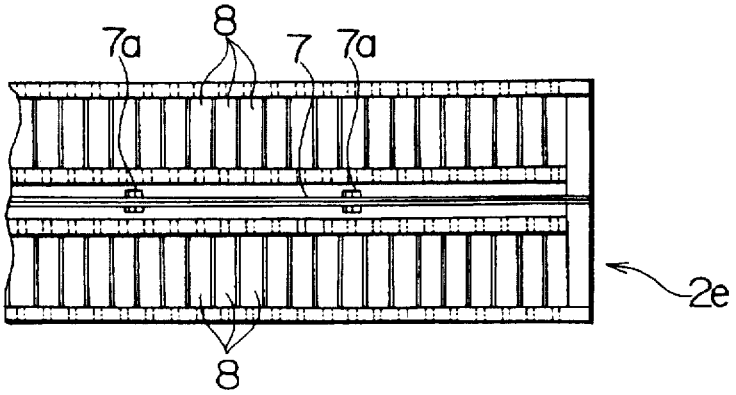
FIG. 5 is a schematic plan view illustrating a portion of a can conveying unit.

Each of the can conveyance units 2*e*, 3 and 4 has the same structure as that of the unit disclosed in Japanese Patent Laid-Open No. 3-293267. The can conveyance unit 2*e* is described below as an example. As shown in FIG. 5, an endless chain 7 is provided along the lengthwise direction of the can conveyance unit 2*e* at the center thereof. Many rollers 8 are disposed at right angles with the moving direction of the chain 7 on both sides thereof so as to be negatively rotatable. Engaging members 7*a* which respectively engage engagement portions provided on cans 6 are mounted on the chain 7 at a predetermined pitch and are moved by driving a motor (not shown). The can conveyance unit 2*e* conveys the full sliver cans 6F from the second end side to the first end side. The can conveyance unit 3 conveys the full sliver cans 6F from the side of the can conveyance unit 2*e* to the side of the can conveyance unit 2*a*, and the can conveyance unit 4 conveys empty cans 6B or the full sliver cans 6F from the side of the can conveyance unit 2*a* to the side of the can conveyance unit 2*e*. Many rollers are disposed in right angles with the lengthwise direction of the can conveyance units 2*a* to 2*d* so as to be negatively rotatable for moving the cans on the rollers.

The cans 6 for supplying a sliver to the roving frame 1 are mounted on each of the four can conveyance units 2*a* to 2*d* which are disposed near the roving frame 1 to form four sliver supply can rows. The can conveyance unit 2*e* disposed behind the four conveyance units 2*a* to 2*d* forms a stock portion for the full sliver cans 6F. The can conveyance units 2*a* to 2*d* are arranged in the state wherein the first and third sliver supply can rows are close to the second and fourth can rows, respectively, and a working path 9 for the worker is ensured between the roving frame 1 and the first row, and between the second and third rows. The can conveyance unit 2*d* and the can conveyance unit 2*e* are also arranged at a predetermined distance for ensuring the working path 9 between the fourth sliver supply can row and the stock portion for the full sliver cans 6F.

Pushers or pressure units 10*a* to 10*d* are provided at positions corresponding to the first side ends of the can conveyance units 2*a* to 2*d* on the side of the can conveyance unit 3 so as to push out the full sliver cans 6F mounted on the can conveyance unit 3 onto the can conveyance units 2*a* to 2*d*, respectively. A pressure unit 10*e* is disposed at a position corresponding to the second end of the can conveyance unit 2*e* on the side of the can conveyance unit 4 so as to push out the full sliver cans 6F mounted on the can conveyance unit 4 onto the can conveyance unit 2*e*.

A can conveyance unit 12 which forms an empty can stock portion 11 is extended along the can conveyance unit 2*e* behind the can conveyance unit 2*e*. The can conveyance unit 12 is disposed so that the first end thereof corresponds to the first end of the can conveyance unit 2*e*, and the second end reaches a position corresponding to the side of the drawing frame 5. The second end of the can conveyance unit 12 is connected to the drawing frame 5 by a conveyor 13. The can conveyance unit 12 is formed so that it can convey cans in the direction from the first end side to the second end side and the reverse direction. The conveyor 13 conveys the empty cans 6B from the second end side of the can conveyance unit 12 toward the drawing frame 5.

Figure 2:
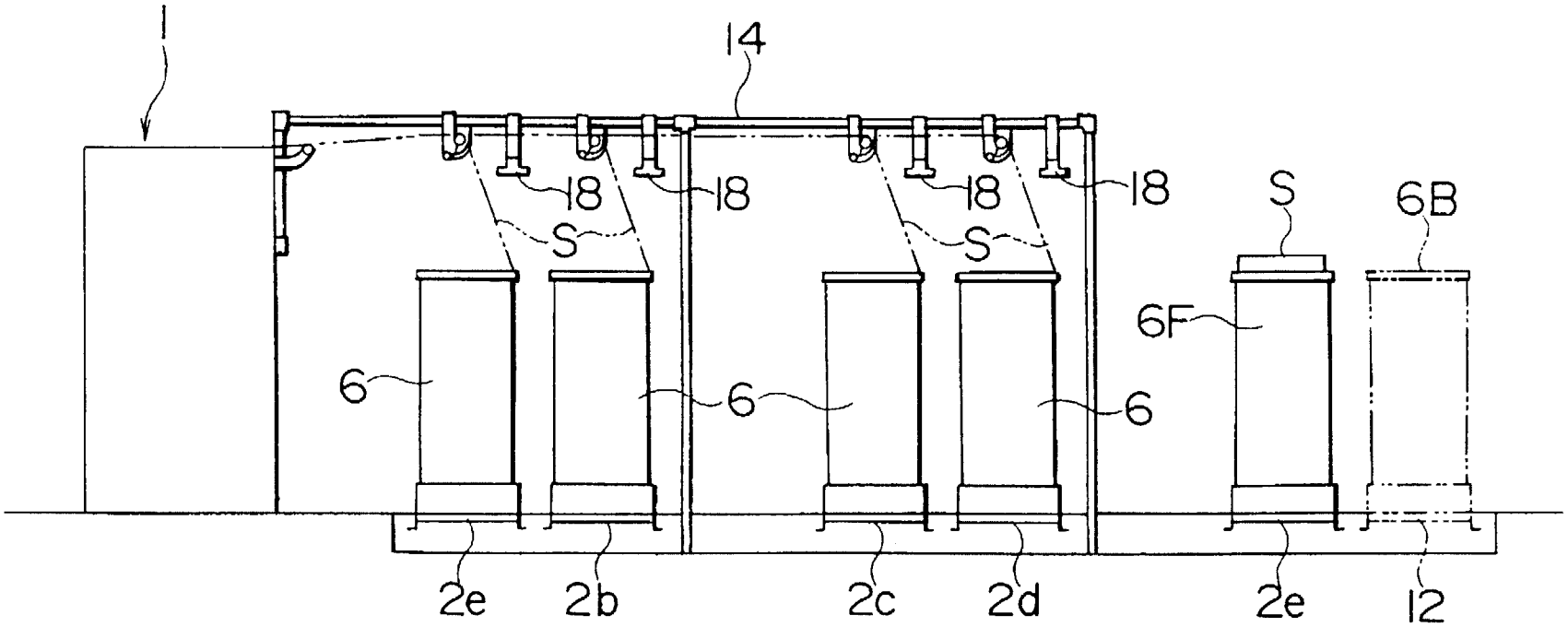
FIG. 2 is a schematic side view illustrating relations among a silver piecing machine, a traveling rail, cans, etc.
Figure 3:
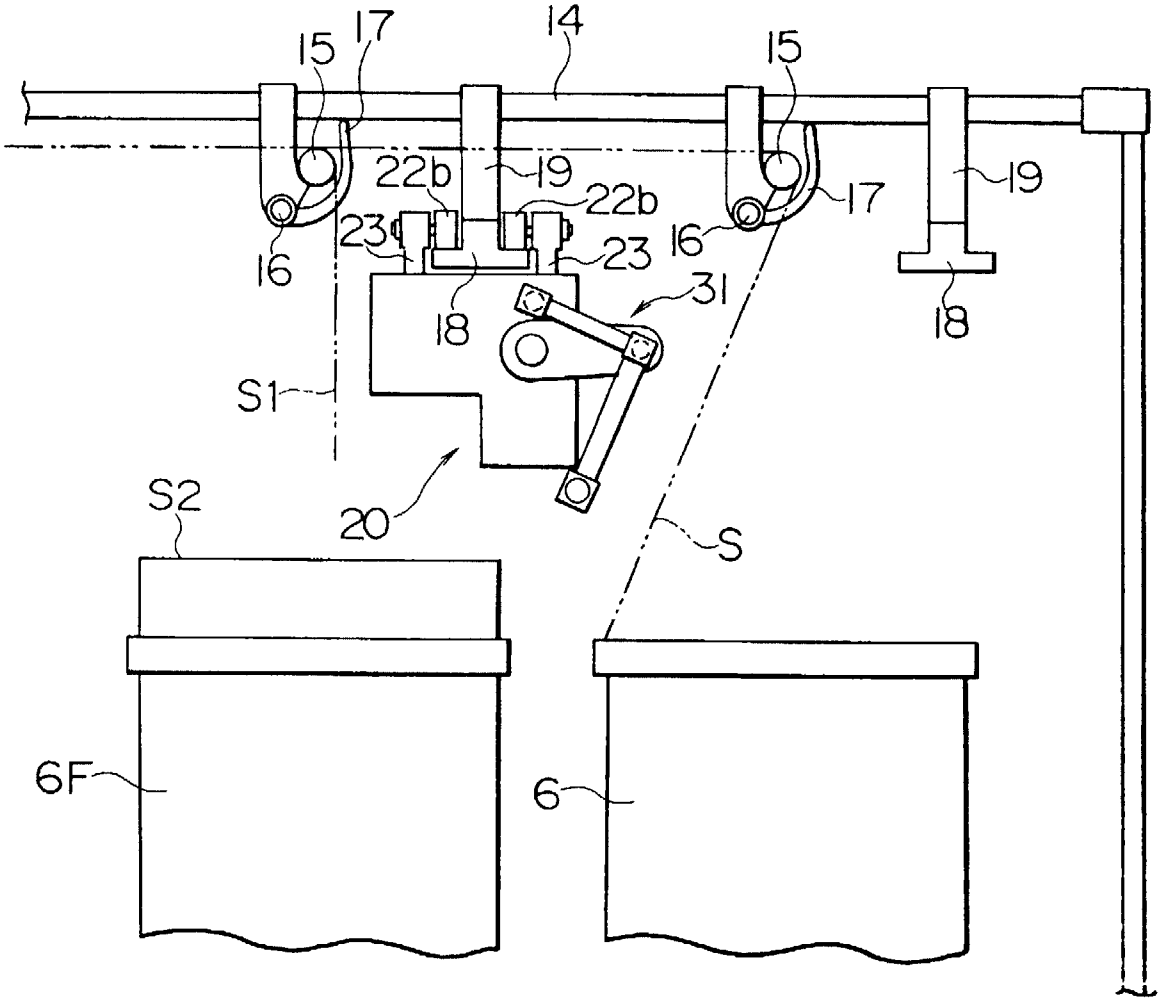
FIG. 3 is a schematic side view illustrating relations among a robing frame, a traveling rail, cans, etc.

As shown in FIG. 3, a creel 14 is extended behind the roving frame 1 in the direction vertical to the lengthwise direction of the roving frame 1. As shown in FIGS. 2 and 3, feed rollers 15 are supported by the creel 14 so as to extend along the lengthwise direction of the roving frame 1. A supporting rod 16 is extended in parallel with each of the feed rollers 15 under and near the rollers 15. A separator 17 for restricting the position of a sliver S is supported at a position of the sliver S rising from each of the cans 6.

Figure 4:
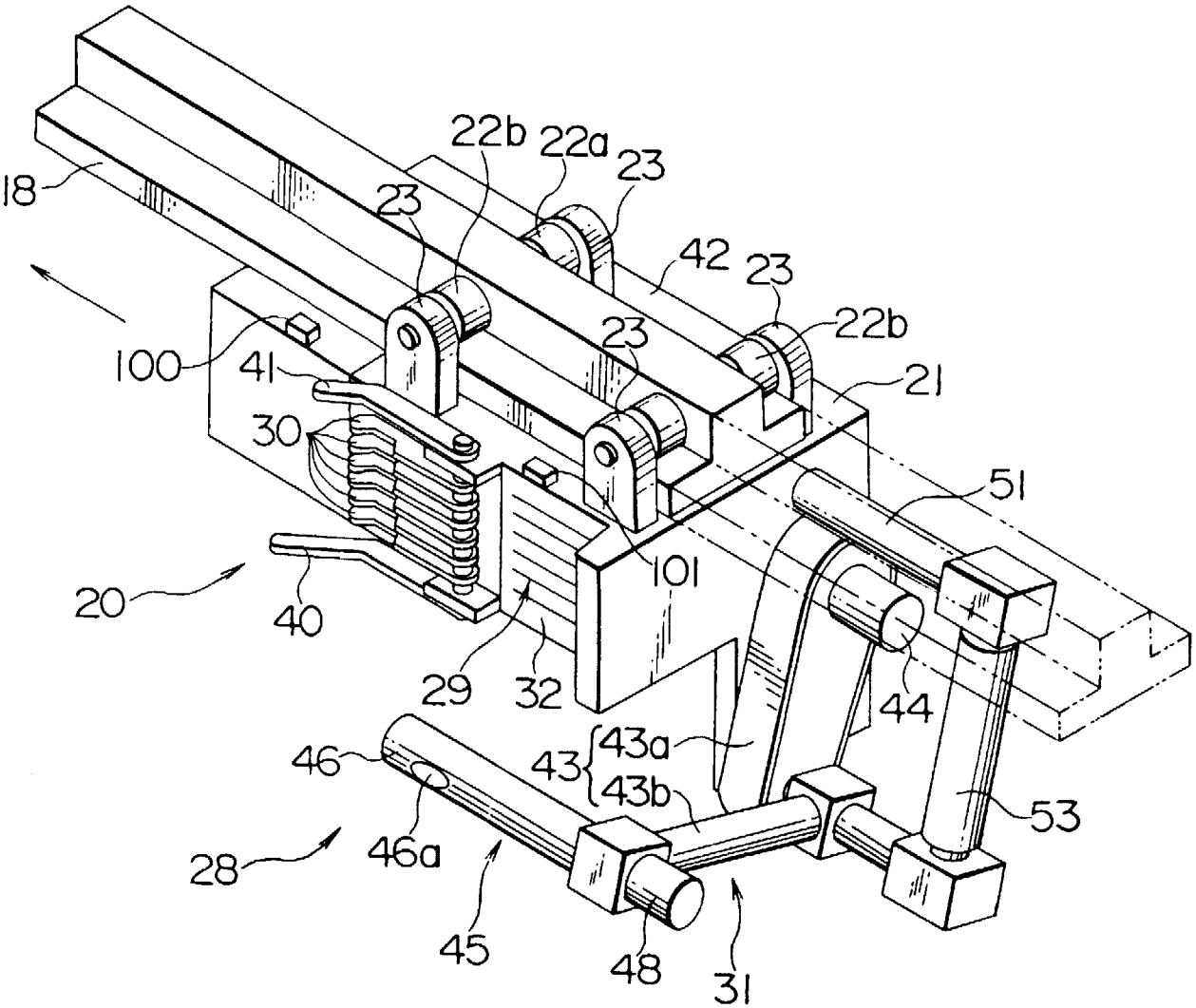
FIG. 4 is a schematic perspective view illustrating a sliver piecing machine as viewed from the side of a silver holding arm.

Traveling rails 18 as moving paths are supported by the creel 14 through brackets 19 so as to extend above the sliver supply can rows along the lengthwise direction of the roving frame 1. A sliver piecing machine 20 is supported by the traveling rails 18 so that it can travel along the rails 18. The sliver piecing machine 20 has a box-like housing 21 (see FIG. 4) which is supported so as to suspend from the traveling rails 118 through brackets 23 each of which is provided with a driving roller 22*a* and a driven roller 22*b*, as shown in FIGS. 2 and 4. The driving rollers 22*a* are driven by a motor (not shown) so that the silver piecing machine 20 is moved along the traveling rails 18 by normal and reverse rotations of the motor. Two photoelectric sensors 100 and 101 are also provided on the upper surface of the housing 21 of the sliver piecing machine 20, as shown in FIG. 4. The sensor 101 is disposed at a position corresponding to the widthwise center of a sliver introduction portion 32, and the sensor 100 is disposed in front of the sensor 101 in the moving direction (in the arrow direction shown in FIG. 4) of the sliver piecing machine 20. Each of the sensors 100 and 101 comprises a light emitting portion and a light receiving portion. The light applied to an old sliver as an object from the light emitting portion is reflected from the object and received by the light receiving portion so that the old sliver on the side of each of the sensors 100 and 101 at right angles with the moving direction of the sliver piecing machine 20 can be detected. When light is detected by the receiving portion of each of the sensors 100 and 101, an on signal is output. The sensors 100 and 101 are started at the same time as start of traveling of the sliver piecing machine 20. When the sensor 100 detects the old sliver, the sliver piecing machine 20 is slowed down. When the sensor 101 detects the old sliver, the travel of the sliver piecing machine 20 is stopped. The operations of the sensors 100 and 101 are also stopped at the same time as the stop of travel of the sliver piecing machine 20. Only the sensor 101 at the widthwise center of the sliver introduction portion 32 may be provided for stopping the sliver piecing machine 20 at the same time as the sensor 101 detects the old sliver. Only the sensor 100 may be provided for starting a timer when detecting the old sliver and stopping the sliver piecing machine 20 after a predetermined time has passed. Alternatively, at least three sensors may be provided for slowing down and stopping the sliver piecing machine 20, or positioning means (not shown) which can engage a positioning member (not shown) provided on the traveling rails 18 may be provided on the sliver piecing machine 20 so that the sliver piecing machine 20 can be stopped at a predetermined sliver piecing position.

As shown in FIG. 1, a rail 24 is placed at right angles with the roving frame 1 on a portion of the floor at the side of the roving frame 1 and the can conveyance unit 3. A carrier 25 is reciprocatably provided on the rail 24. The carrier 25 is formed so that the sliver piecing machine can be loaded thereon, and can be moved to a position corresponding to the traveling rail 18 opposite to the sliver supply can row for which the sliver piecing work is required. The carrier 25 is provided with a bridge rail 26 which can be connected to the traveling rails 18. The sliver piecing machine 20 can be moved between the traveling rails 18 and the carrier 25 through the bridge rail 26.

The driving of the can conveyance units 2*a* to 2*e*, 3, 4 and 12 and the conveyer 13 is controlled by commands from a can conveyance controller C, and the roving frame 1, and carrier 25 and the can conveyance controller C are driven on the basis of commands from a host computer HC.

The sliver piecing machine 20 comprises a sliver cutting device 27 (shown in FIG. 9) which is provided on the front side thereof in the forward movement direction along the traveling rails 18 (movement in the direction away from the carrier 25), and a sliver piecing device 28 provided on the rear side. The sliver piecing device 28 comprises a sliver piecing unit 29, a sliver presser 30, a sliver holding arm 31, etc.

Figure 6:
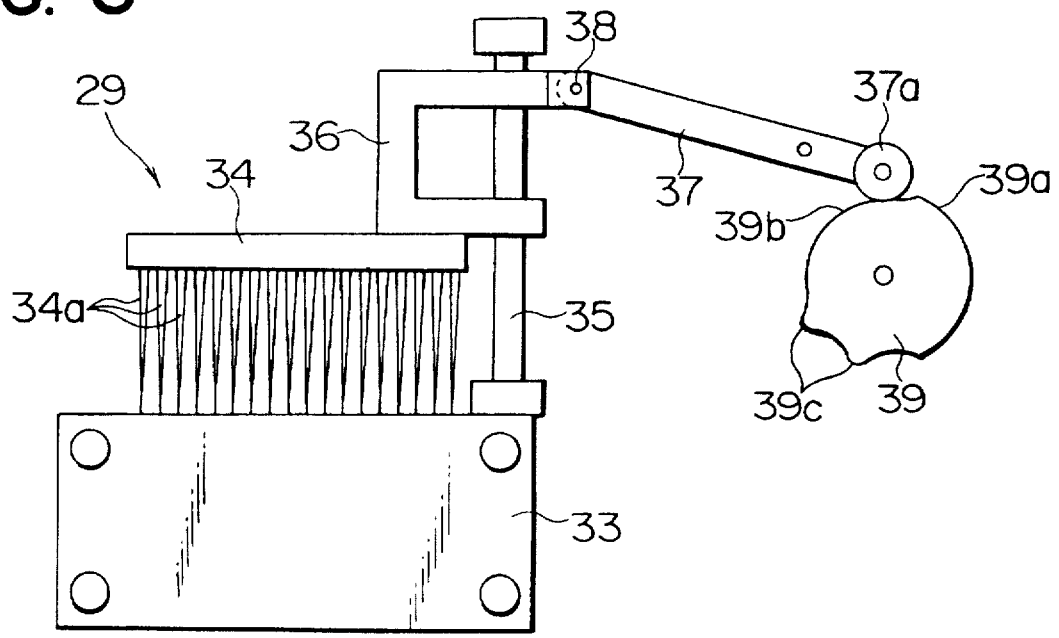
FIG. 6 is a schematic plan view illustrating a silver piecing unit.
Figure 7:
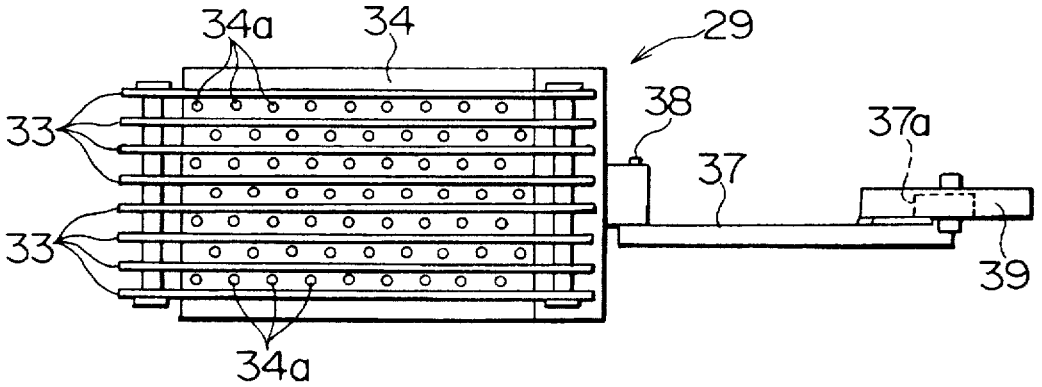
FIG. 7 is a schematic front view illustrating a sliver piecing unit.

As shown in FIG. 4, the sliver introduction portion 32 which is vertically extended is provided on the front side of the housing 21. In the housing 21, the sliver piecing unit 29 is disposed at a position opposite to the silver introduction portion 32. The sliver piecing unit 29 comprises many separate plates 33 arranged in parallel at predetermined intervals, and a needle plate 34 having many needles 34*a* erected thereon, as shown in FIGS. 6 and 7. The needle plate 34 is supported by a pair of guide rods 35 through a supporting block 36, which are horizontally extended at right angles with the movement direction of the sliver piecing machine 20. A cam lever 37 is oscillatably supported on the side of the supporting block 36. the supporting block 36 being connected to the cam lever 37 through a pin 38 which is passed through an elongated hole (not shown) formed at the first end thereof. The cam lever 37 is kept in a state wherein a cam follower 37*a* provided at the second end thereof contacts a cam 39. The cam 39 is formed into a shape having a large diameter portion 39*a* continued over a range of about ⅓ of the entire periphery, a small diameter portion continued over a range of about ⅓, and a plurality of projections (in this embodiment, two projections) which are provided between the large diameter portion 39*a* and the small diameter portion 39*b*. When the cam 39 is rotated by operation of a motor (not shown), the cam lever 37 is oscillated. When the cam follower 37*a* engages the small diameter portion 39*b*, the needle plate 34 is at a standby position where the needles 34*a* are retracted between the respective separate plates 33. When the cam follower 37*a* engages with the large diameter portion 39*a* or the projections 39*c*, the needle plate is at an operating position where the needles 34*a* enters between the respective separate plates 33.

As shown in FIG. 4, the housing 21 has a silver taking-in lever 40 for new slivers which is rotatably provided on the lower side of the silver introduction portion 32, and a sliver taking-in lever 41 for old slivers which is rotatably provided on the upper side thereof. The silver taking-in levers 40 and 41 and the silver presser 30 are rotated between the standby position and the operating position by operation of a driving device (not shown).

A collecting box 42 is provided in the housing 21, the pressure in the collecting box 42 being made negative by operation of a blower (not shown). A silver holding arm 31 is provided on the wall of the housing 21 on the rear side thereof in the forward direction (the arrow direction shown in FIG. 4) of the sliver piecing machine 20. A biaxial driving arm 43 which forms the sliver holding arm 31 comprises a first arm 43*a* and a second arm 43*b*, the first arm 43*a* being oscillated around the base end thereof by a driving device (not shown). The second arm 43*b* is rotatably supported at the end of the first arm 43*a*, and is oscillated, through a driving mechanism (not shown), by a motor 44 provided at the base end of the first arm 43*a*.

Figure 8:
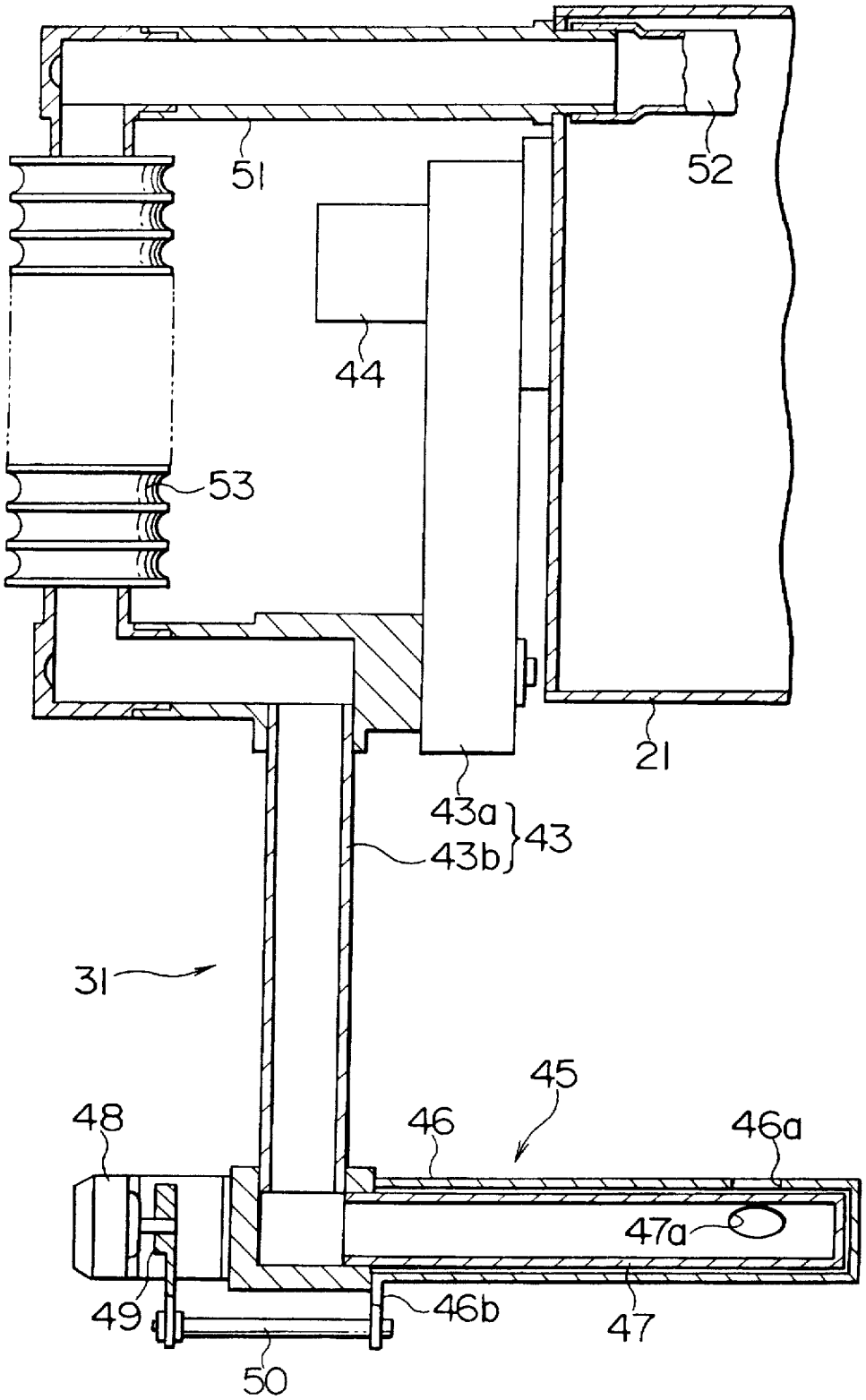
FIG. 8 is a partially broken-out rear view illustrating a sliver holding arm.

As shown in FIG. 8, the second arm 43*b* is formed in a hollow shape, and has a sliver holding unit 45 provided at the end thereof. A fixed supporting cylinder 47 which forms the sliver holding unit 45 is supported at right angles with the second arm 43*b* by the second arm 43*b* at the base end thereof. A suction pipe 46 is rotatably fitted on the outside of the supporting cylinder 47. The suction pipe 46 is formed in a length which permits the end thereof to correspond to the silver introduction portion 32, and has the closed end and a suction hole 46*a* formed near the end thereof. A through hole 47*a* is formed in the supporting cylinder 47 in correspondence with the suction hole 46*a*. A connecting piece 46*b* is projected from the outer periphery of the suction pipe 46 near the base end thereof so as to be at right angles with the lengthwise direction of the suction pipe 46. A rotary actuator (rotary solenoid) 48 is fixed at the base end of the supporting cylinder 47, and the connecting piece 46*b* is integrally rotatably connected to a lever 49 fixed to the driving shaft through a connecting rod 50. The suction pipe 46 can be rotated between an open position where the suction hole 46*a* is opposite to the through hole 47*a*, and a closed position where the suction hole 46*a* is not opposite to the through hole 47*a*.

A pipe 51 is fixed at a position near the base end of the first arm 43*a* in parallel with the suction pipe 46. The first end of the pipe 51 is connected to the collecting box 42 through a hose 52, and the second end of the pipe 51 is connected to the second arm 43*b* through a bellows hose 53. Namely, the suction pipe 46 communicates with the collecting box 42 through the second arm 43*b*, the bellows hose 53, the pipe 51 and the hose 52.

Figure 9:
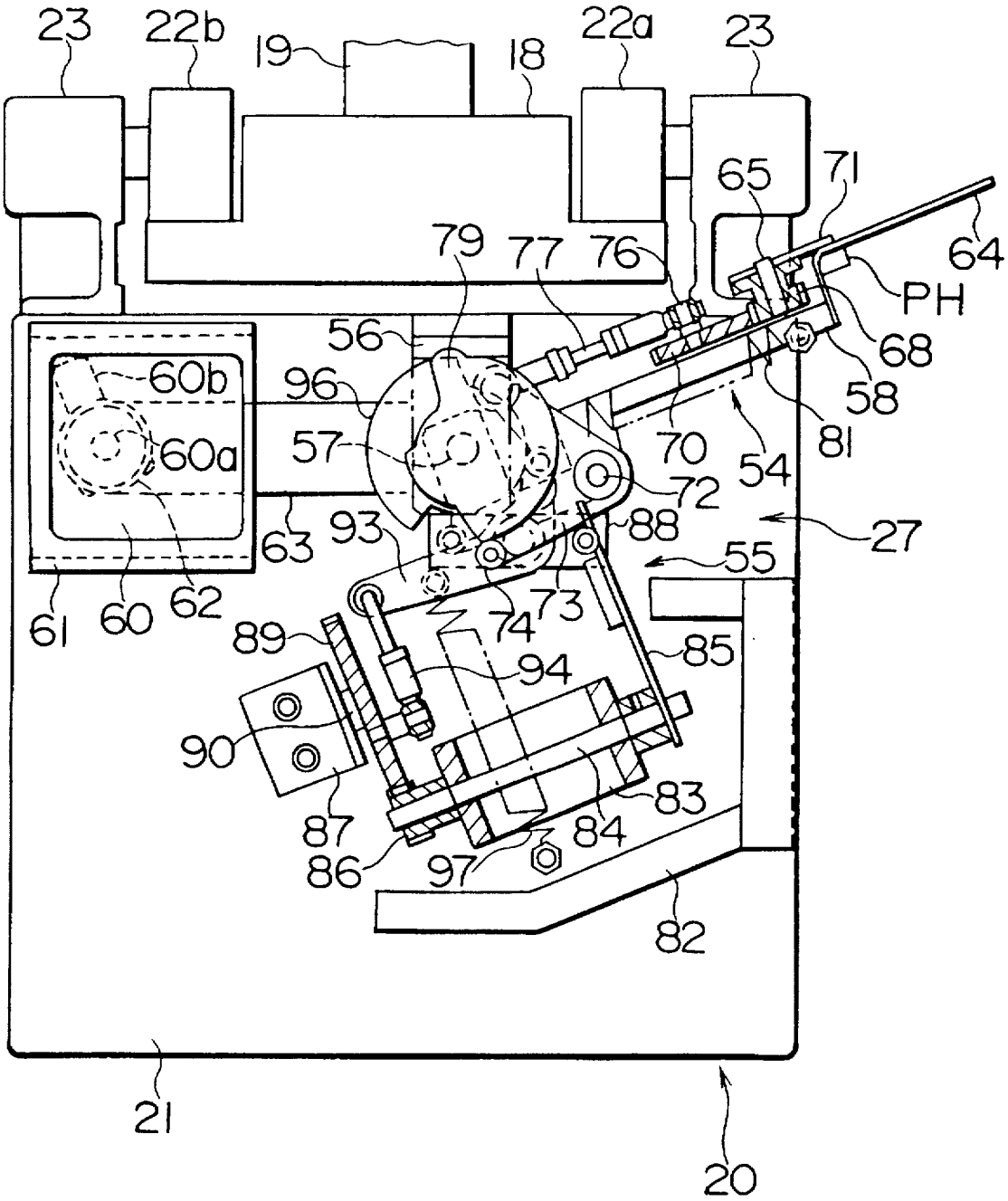
FIG. 9 is a partially broken-out side view illustrating a sliver cutting unit.

As shown in FIG. 9, the sliver cutting device 27 comprises silver capturing means 54 provided with a holding portion which can capture and hold a set sliver (a sliver being supplied), and holding means 55 for holding the sliver S which is captured by the holding portion. The capture of the sliver S represents the state where unlike a holding state, the sliver S engages the holding portion so as to be freely movable in the lengthwise direction thereof.

Figure 10:
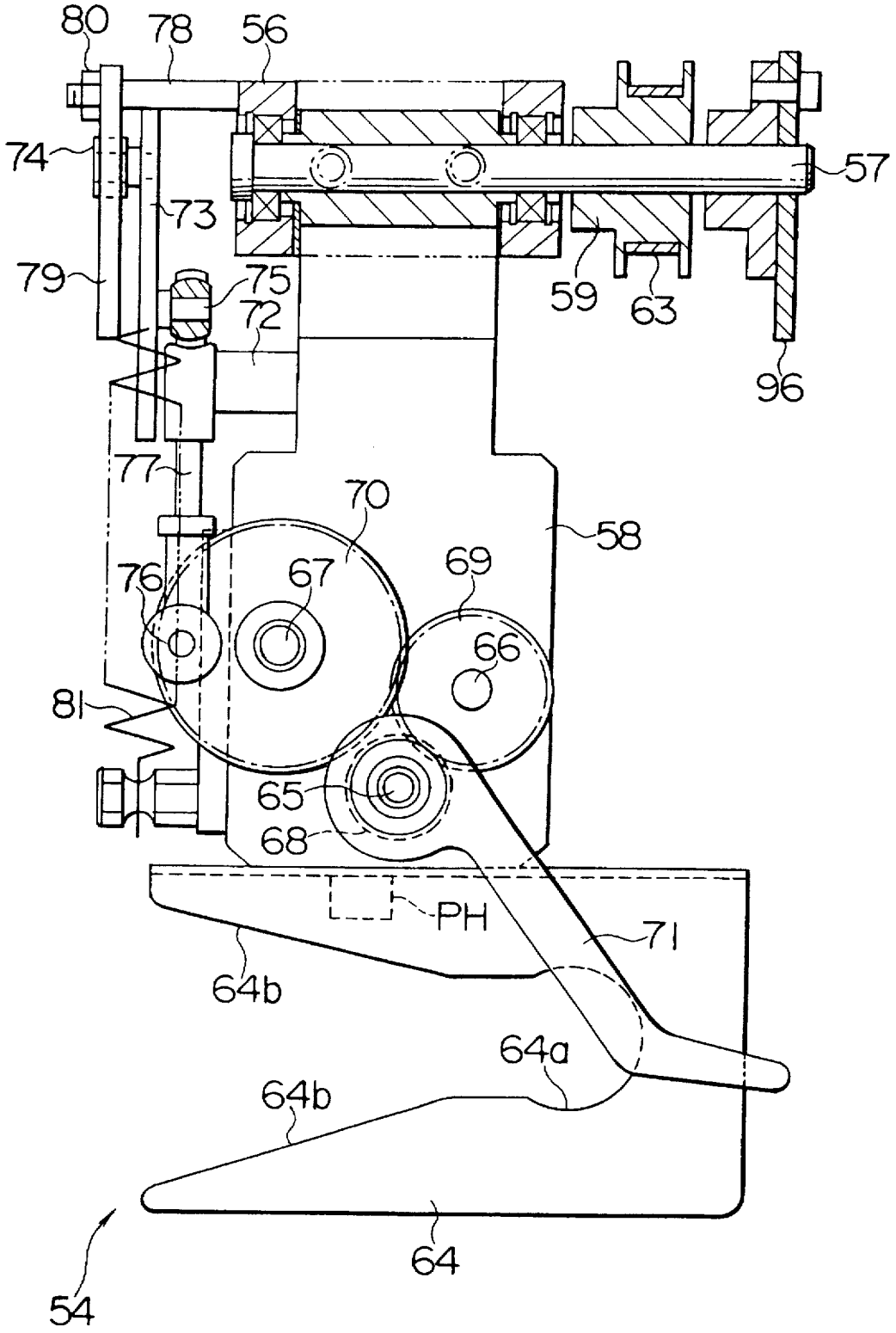
FIG. 10 is a partially broken-out front view illustrating a supporting arm.

Referring to FIGS. 9 and 10, a supporting bracket 56 is fixed to the upper portion of the housing 21, a rotational shaft 57 being supported by the supporting bracket 56 so as to extent along the movement direction of the automatic machine 20 and have an end projecting from the side of the bracket 56. The base end of the supporting arm 58 is integrally rotatably supported at a position of the rotational shaft 57 corresponding to the supporting bracket 56. A toothed pulley 59 (shown in FIG. 10) is integrally rotatably supported in an intermediate portion of the rotational shaft A motor 60 which can normally and reversely rotate is fixed to the housing 21 through the bracket 61 behind the rotational shaft 57 (on the left of FIG. 9). A toothed pulley 62 is integrally rotatably fixed to the driving shaft 60*a* of the motor 60. A toothed belt 63 is located between both toothed pulleys 59 and 62. The supporting arm 58 is thus oscillated, by the normal and reverse rotation of the motor 60, between a capture start position where the supporting arm 58 upwardly extends at an angle, as shown in FIG. 9, and a position (shown in FIG. 21) to which the supporting arm 58 is rotated for about 140 from the capture start position in the counterclockwise direction shown in FIG. 9.

Further, a detected member 60*b* is integrally rotatably fixed to the driving shaft 60*a* of the motor 60. A sensor (not shown) is also provided on the bracket 61 so as to detect the detected member 60*b* when the supporting arm 58 is at the capture start position and the position shown in FIG. 21.

At the end of the supporting arm 58 is fixed a capturing piece 64 which forms the capturing portion. As shown in FIG. 10, the capturing piece 64 has an engaging portion 64*a* having a diameter greater than that of the sliver S, and a substantially V-shaped guide portion 64*b* which is continued from the engaging portion 64*a*. The guide portion 64*b* is fixed so as to be opposite to the movement direction of the automatic machine 20 on the sliver cutting work. Support shafts 65, 66 and 67 are erected on a portion of the upper surface of the supporting arm 58 near the end thereof. A driven gear 68, an intermediate gear 69 and a drive gear 70 are rotatably supported by the support shafts 65, 66 and 67, respectively. The driven gear 68 and the drive gear 70 engage the intermediate gear 69. The base end of a first holding lever 71 is integrally rotatably fixed to the driven gear 68. The first holding lever 71 is disposed so as to be rotatable along the upper surface of the capturing piece 64 while crossing the engaging portion 64*a* and the guide portion 64*b*. The upper sides of the supporting arm 58 and of the capturing piece 64 when the supporting arm 58 is horizontally placed are defined as the upper surfaces thereof.

A photoelectric sensor PH is also provided at a position of the capturing piece 64 where the sliver S entering the guide portion 64*b* can be detected. During movement of the sliver piecing machine 20 on the cutting work, when the sliver S is detected, a command to start the operation of cutting the sliver is output.

Figure 11:
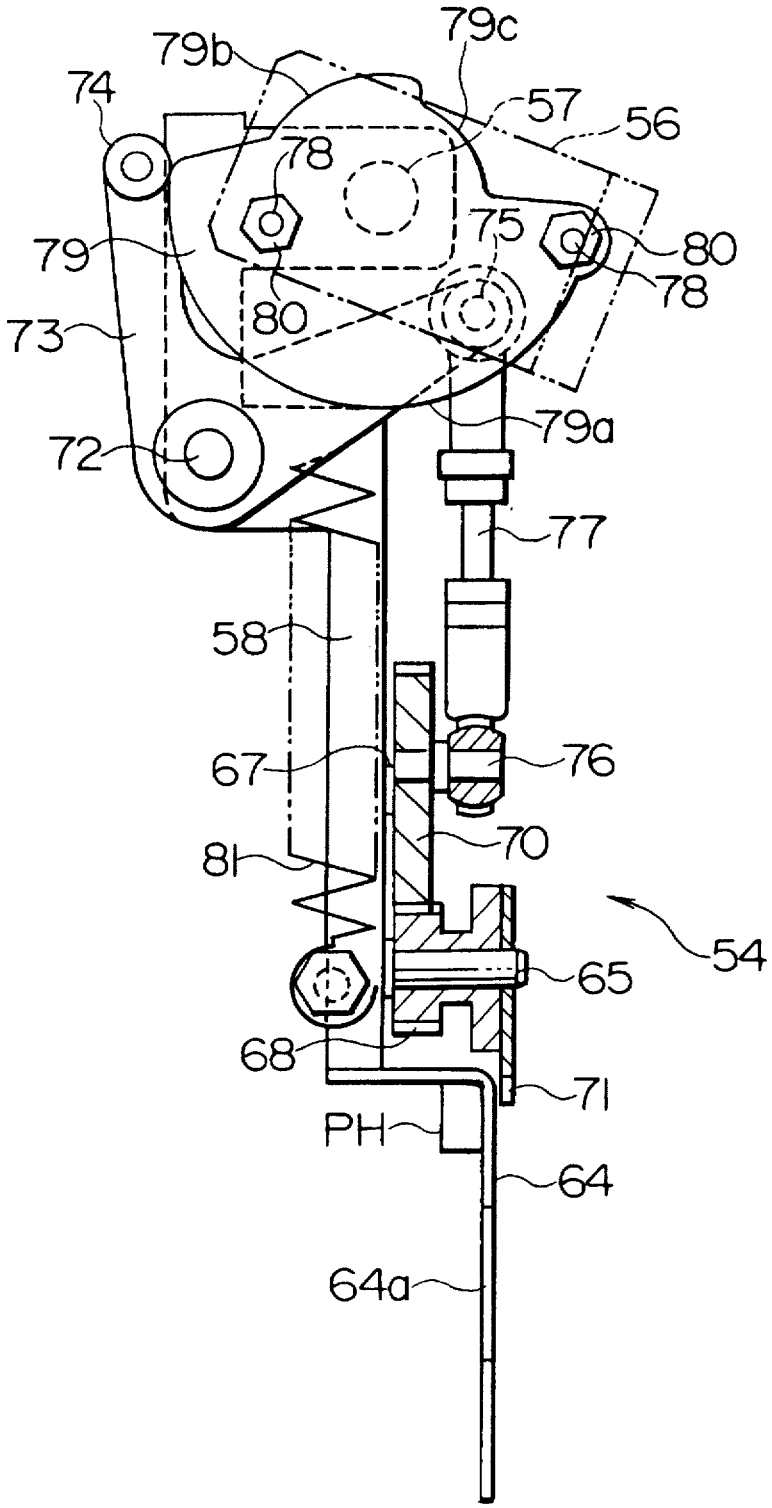
FIG. 11 is a partially broken-out side view of a supporting arm.

As shown in FIGS. 9, 10 and 11, a support 72 is projected from the side of the supporting arm 58, and a substantially V-shaped first cam lever 73 is rotatably supported at the center of the support 72. A cam follower 74 is rotatably supported at the first end of the first cam lever 73, and a pin 75 is projected from the second end thereof. A pin 76 is projected from a portion of the upper surface of the drive gear 70 near the periphery thereof. The first end of a connecting rod is rotatably supported by the pin 75, and the second end thereof is supported so as to be oscillatable in a plane vertical to the driving gear 70 relative to the pin 76.

As shown in FIGS. 10 and 11, a pair of supports 78 are projected from the supporting bracket 56, an external thread portion being formed on each of the supports 78. A first cam 79 for driving the first cam lever 73 is fastened to the ends of the supports 78 by nuts 80. A tension spring 81 is stretched between the first cam lever 73 and the supporting arm 58 so as to urge the first lever 73 to rotate in the direction of pressure contact between the cam follower 74 and the first cam 79. The cam surface of the first cam 79 is formed in a shape in which three circular surfaces 79*a*, 79*b* and 79*c* having the same center and different radii are smoothly connected.

The radii of the circular surfaces 79*a*, 79*b* and 79*c* are in the order of the circular surface 79*a*> the circular surface 79*b*> the circular surface 79*c*. The first cam 79 is formed so that the circular surfaces 79*a*, 79*b* and 79*c* engage the cam follower 74 when the supporting arm 58 is at the capture start position (shown in FIG. 9), the horizontal position and the vertical position, respectively. In the states of engagement between the cam follower 74 and the circular surfaces 79*a*, 79*b* and 79*c*, the first holding lever 71 is at the retracted position where the first holding lever 71 does not cross the capturing piece 64, the capture position where it crosses the capturing piece 64, and the holding position where it crosses the engaging portion 64*a*, respectively. The cam follower 74 successively engages the circular surfaces 79*a*, 79*b* and 79*c* with the rotation of the first arm 58.

Figure 12:
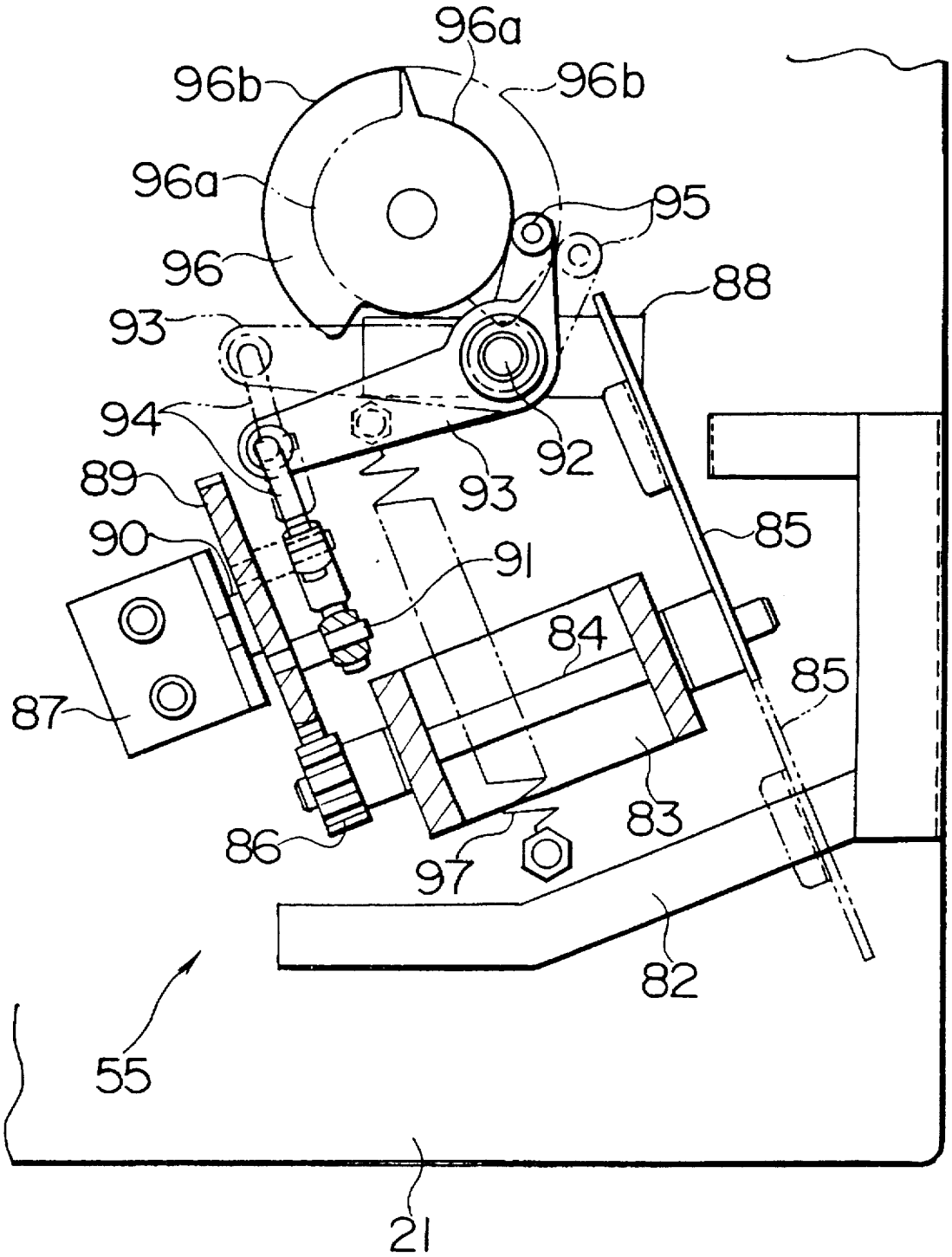
FIG. 12 is a side view illustrating holding means.

As shown in FIGS. 9 and 12, a guide plate 82 is fixed in the lower portion of the housing 21 substantially corresponding to the movement locus of the capturing piece 64, and a supporting bracket 83 is fixed above the guide plate 83. A rotational shaft 84 is rotatably supported by the supporting bracket 83, a second holding lever 85 which forms holding means 55 being integrally rotatably fixed to the first end of the rotational shaft 84. A driven gear 86 is integrally rotatably fixed to the second end of the rotational shaft 84.

In the housing 21, a bracket 87 is fixed above the supporting bracket 83 off to the left in the drawings, and a bracket 88 is fixed above the supporting bracket 83. A driving gear 89 having a diameter greater than that of the driven gear 86 is rotatably supported by the bracket 87 so as to engage the driven gear 86 through a supporting shaft 90. A support pin 91 is projected from a portion of the driving gear 89 near the periphery thereof. On the other hand, a support 92 is projected from the bracket 88 so as to extend in parallel with the rotational shaft 57, a second cam lever 93 which forms the holding means 55 being rotatably supported by the support 92. The second cam lever 93 and the driving gear 89 are connected to each other through a connecting rod 94 which is bent at right angles on the first end side thereof. The first end of the connecting rod 94 is rotatably connected to the first end of the second cam lever 93, and the second end is supported so as to be oscillatable in a plane vertical to the driving gear 89 relative to the supporting pin 91. A cam follower 95 is rotatably mounted on the second end of the second cam lever 93.

Figure 13:
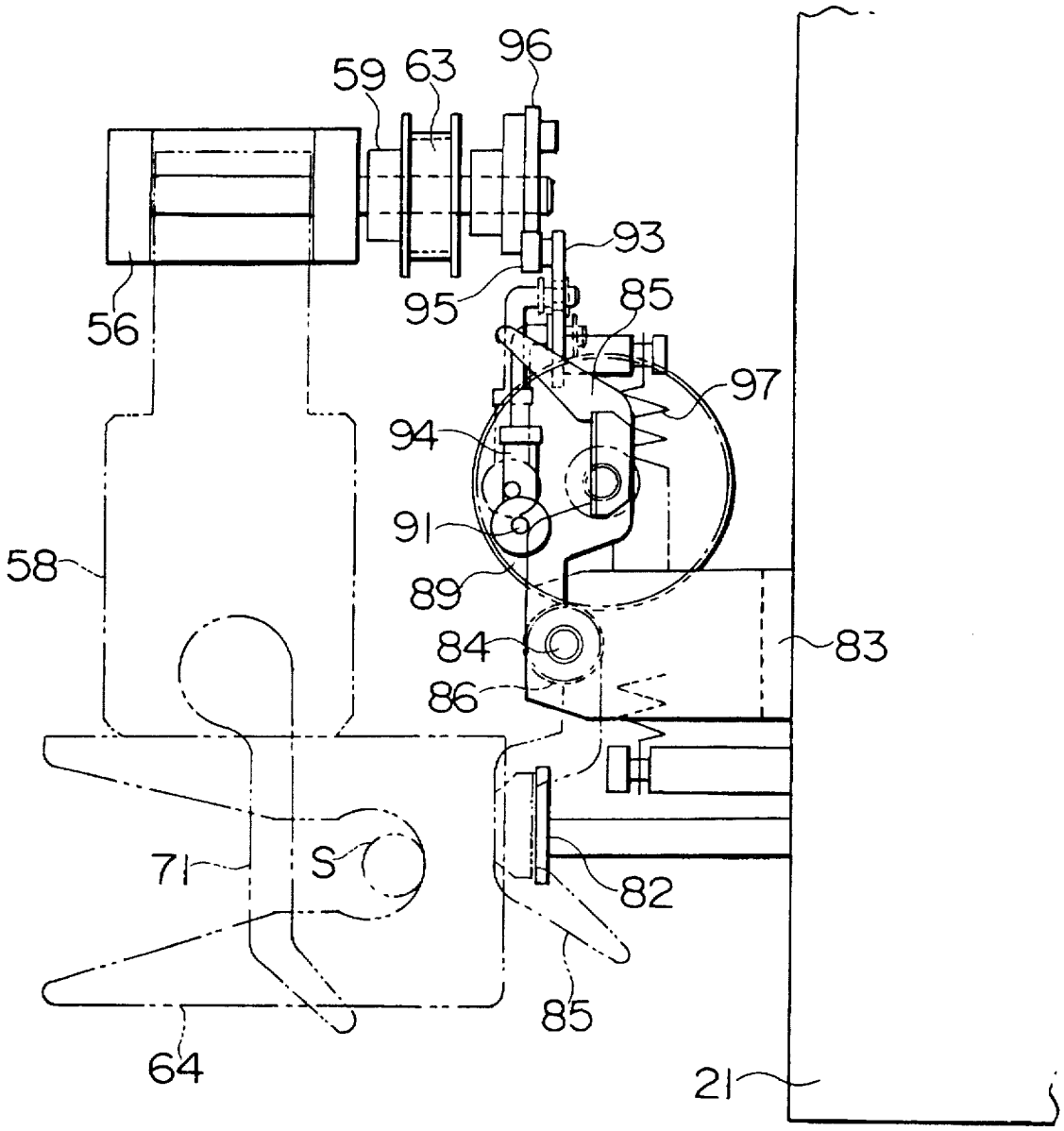
FIG. 13 is a front view illustrating holding means.

As shown in FIGS. 10 and 13, a second cam 96 is integrally rotatably fixed to the end of the rotational shaft 57 to which the supporting arm 58 is fixed. A tension spring 97 is stretched between the second cam lever 93 and the housing 21. The second cam lever 93 is urged by the tension spring 97 to rotate in the direction of pressure contact between the cam follower 95 and the second cam 96. Referring FIG. 12, the cam surface of the second cam 96 is formed in a shape in which two circular surfaces 96*a* and 96*b* having the same center and different radii are smoothly connected. The radii of both circular surfaces 96*a* and 96*b* are in the order of the circular surface 96*a*> the circular surface 96*b*.

When the supporting arm 58 is between the capture start position and the position in substantially parallel with the second holding lever 85, the circular surface 96*a* of the second cam 96 engages the cam follower 95. When the supporting arm 58 is further rotated in the counterclockwise direction in FIG. 19 from the position in substantially parallel with the second holding lever 85, the circular surface 96*b* of the second cam 96 engages the cam follower 95. In the state where the cam follower 95 engages the circular surface 96*a*, the second holding lever 85 is at the standby position where it upwardly extends. In the state where the cam follower 95 engages the circular surface 96*b*, the second holding lever 85 is at the holding position where it engages the guide plate 82. The cam follower 95 successively engages the circular surfaces 96*a* and 96*b* with the rotation of the second cam 96 integral with the supporting arm 58.

On the housing 21 is mounted a control box (not shown) for transmitting signals between the housing 21 and the carrier 25, and controlling drive of the sliver cutting device 27, the sliver piecing device 28, the traveling motor, etc.

The operation of the apparatus configured as described above is described below.

The sliver piecing machine 20 waits in the state where it is loaded on the carrier 25. When the sliver S contained in the cans 6 which is supplying the sliver approaches the sliver piecing machine 20, a command is output from the host computer HC to the carrier 25 to move to a position opposite to the corresponding can row. The carrier 25 is moved according to the command and is stopped at a position opposite to the sliver can row to be replaced, as well as connecting the bridge rail 26 to the traveling rail 18.

A signal is transmitted between the sliver piecing machine 20 and the carrier 25, and when the stop of the roving frame 1 is confirmed, the sliver cutting work is started. Namely, after the bridge rail 26 is completely connected to the traveling rails 18, the sliver piecing machine 20 is separated from the carrier 25, and reciprocated along the traveling rails 18. In the forward movement of the sliver piecing machine 20 toward the second end side (the side opposite to the carrier 25) of the traveling rails 18, the sliver piecing machine 20 performs only the sliver cutting work while traveling. In the backward movement, the sliver piecing machine 20 is stopped at the piecing position and performs only the sliver piecing work. A signal is transmitted between the sliver piecing machine 20 and the carrier 25, and when the stop of the roving frame 1 is confirmed, the sliver cutting work is started. When the roving frame 1 is not stopped, the sliver piecing machine 20 waits at a predetermined position on the traveling rail 18 until the roving machine 1 is stopped.

The sliver cutting work is described below.

Figure 15:
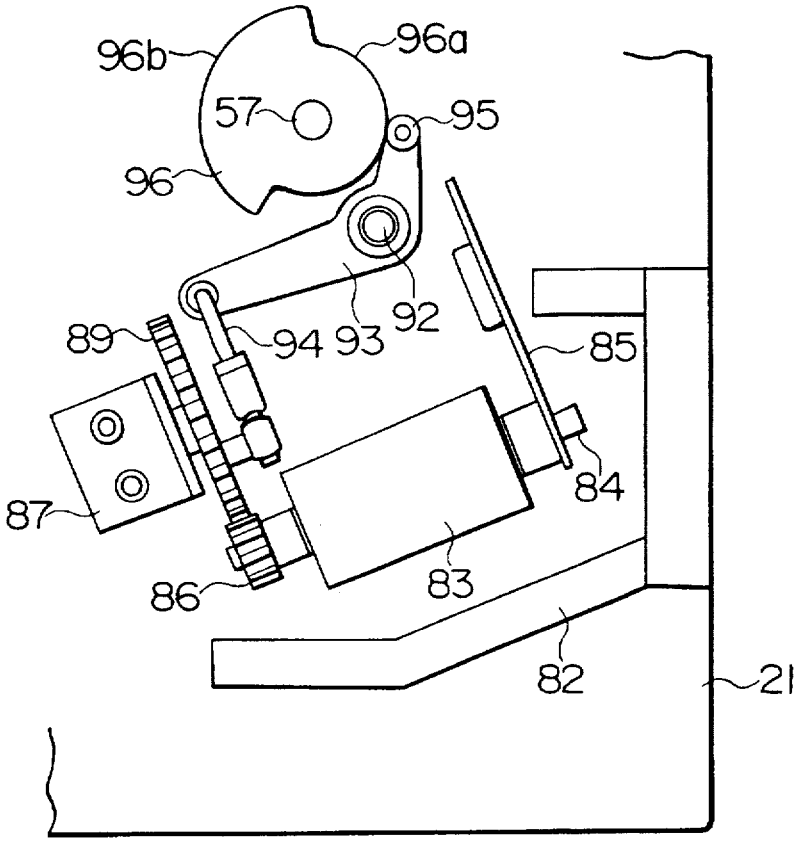
FIG. 15 is a schematic side view illustrating holding means corresponding to FIG. 14.
Figure 16:
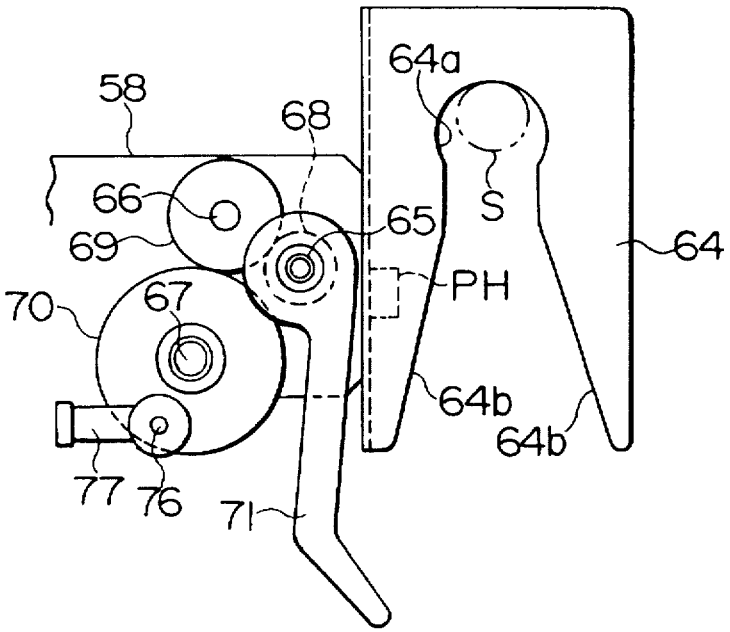
FIG. 16 is a schematic front view illustrating a relation between a first holding lever and a capturing member corresponding to FIG. 14.

When the sliver piecing machine 20 does not perform the sliver cutting work, the supporting arm 58 is at a position (shown in FIG. 21) where the capturing piece 64 and so on cannot engage the sliver S. In the sliver cutting work, the sliver piecing machine 20 is moved to the position opposite to the sliver S to be cut with the supporting arm 58 at the capture start position. In this state, the cam follower 74 engages the circular surface 79*a* of the first cam 79 in the vicinity of the termination of the circular surface 79*a*, and the first holding lever 71 is at the retracted position shown in FIG. 16. The capturing piece 64 is maintained in the state where the guide portion 64*a* is opposite to a portion of the sliver S which extends from the feed roller 15 to a position just below it. As shown in FIG. 15, the cam follower 95 engages the circular surface 96*a* of the second cam 96, and the second holding lever 85 is maintained at the retracted position. In this state, when the sliver piecing machine 20 is moved to the position opposite to the sliver S to be cut, the sliver S engages the engaging portion 64*a* of the capturing piece 64, as shown in FIG. 16. The sliver S is sometimes present in the guide portion 64*b* of the capturing piece 64.

When the operation of the roving frame 1 is stopped for the sliver piecing work, the position of the sliver S extending from the can 6 to the feed roller 15 is changeable. However, since the sliver S substantially straightly extends by its own weight under the separator 17 in the vicinity thereof, the sliver S is securely captured by the capturing piece 64.

Figure 14:
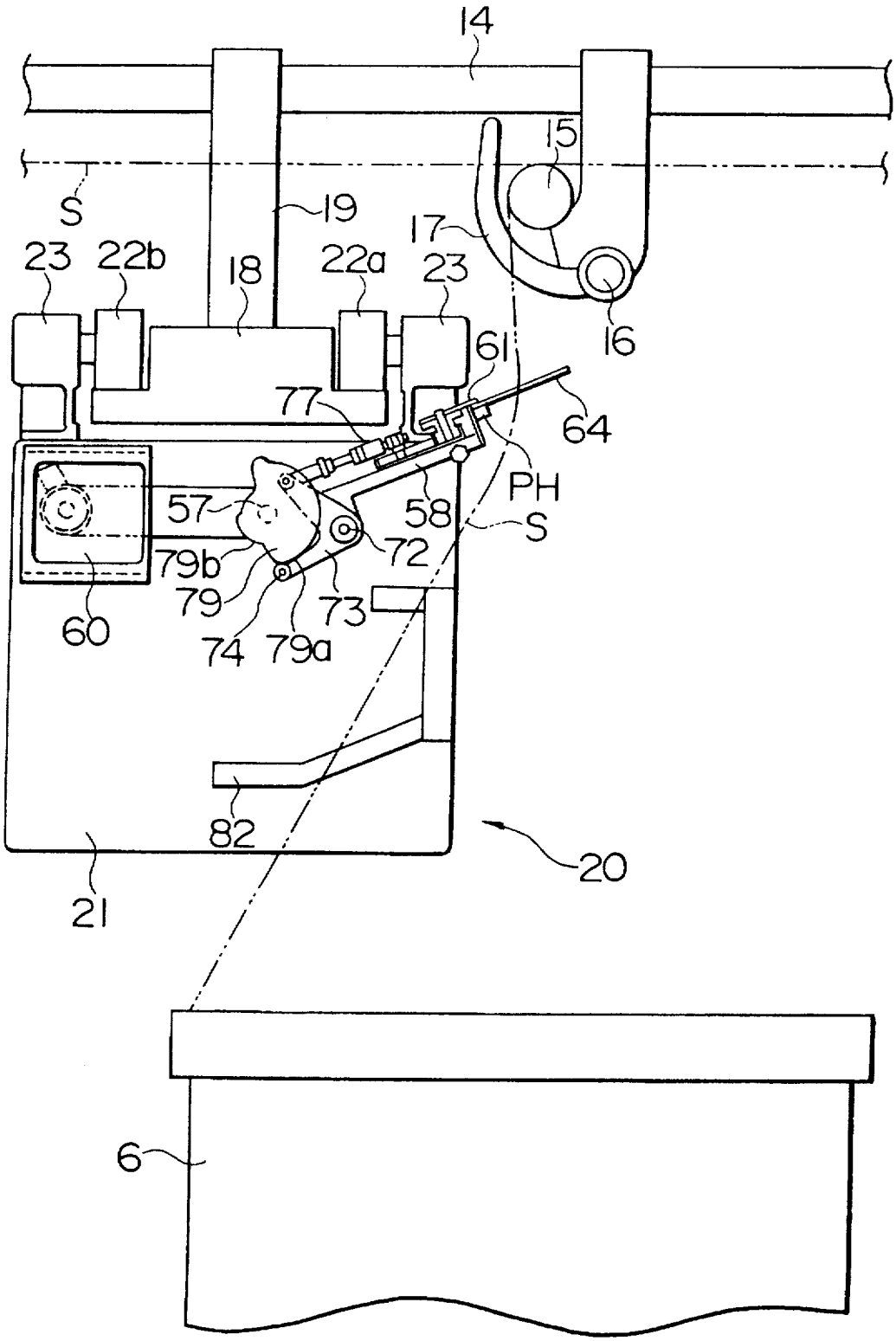
FIG. 14 is a schematic side view illustrating the operation of a sliver cutting unit.
Figure 17:
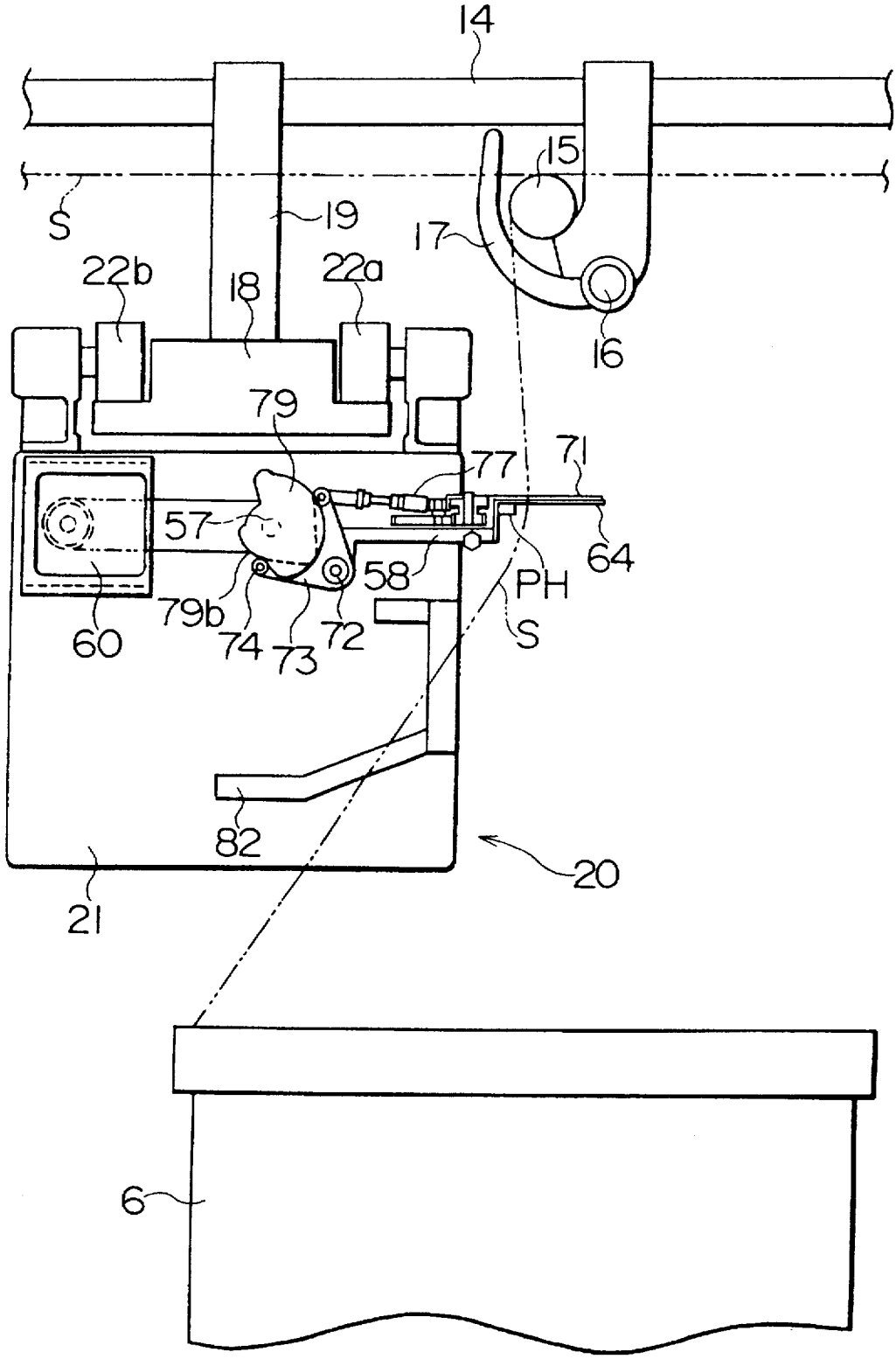
FIG. 17 is a schematic side view illustrating the operation of a sliver cutting unit.
Figure 18:
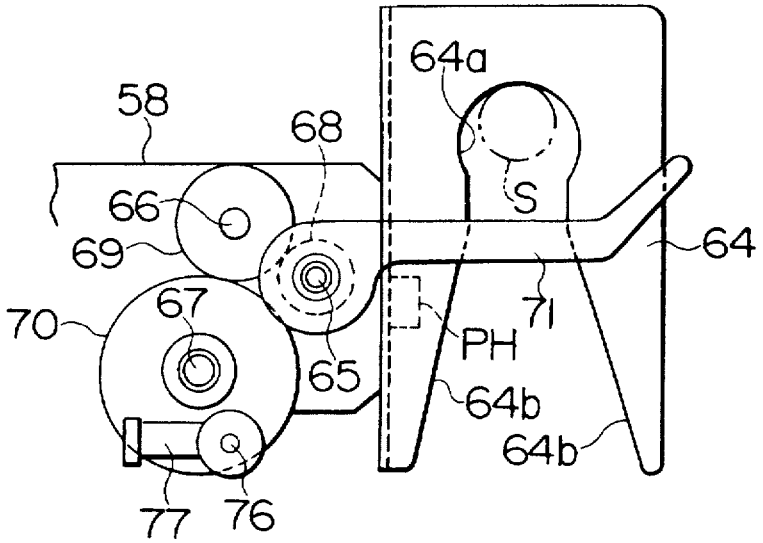
FIG.18 is a schematic front view illustrating a relation between a first holding lever and a capturing member corresponding to FIG. 17.

The motor 60 is then normally rotated, the rotational shaft 57 is rotated in the counterclockwise direction in FIG. 14 through the toothed pulley 59, the toothed belt 63 and the toothed pulley 62, and the supporting arm 58 and the second cam 96 are also rotated in the same direction. The engagement between the cam follower 74 and the circular surface 79*a* is immediately released by rotation of the supporting arm 58, and the cam follower 74 engages the connecting surface between the circular surface 79*a* and the circular surface 79*b*. When the rotational shaft 57 is rotated to the position where the supporting arm 58 is substantially horizontal, as shown in FIG. 17, the cam follower 74 engages the circular surface 79*b*. The driving gear 70 is rotated through the connecting rod 77 during the rotation of the first cam lever 73 from the position where the cam follower 74 engages the circular surface 79*a* to the position where the cam follower 74 engages the circular surface 79*b*. The driven gear 68 is then rotated through the intermediate gear 69 so that the first holding lever 71 is rotated together with the driven gear 68 from the retracted position to the capture position shown in FIG. 18. On the other hand, during this time, the second cam 96 is rotated while the circular surface 96*a* thereof engages the cam follower 95, and the second cam lever 93 maintained at the same position, the second holding lever 85 being maintained at the standby position.

Figure 19:
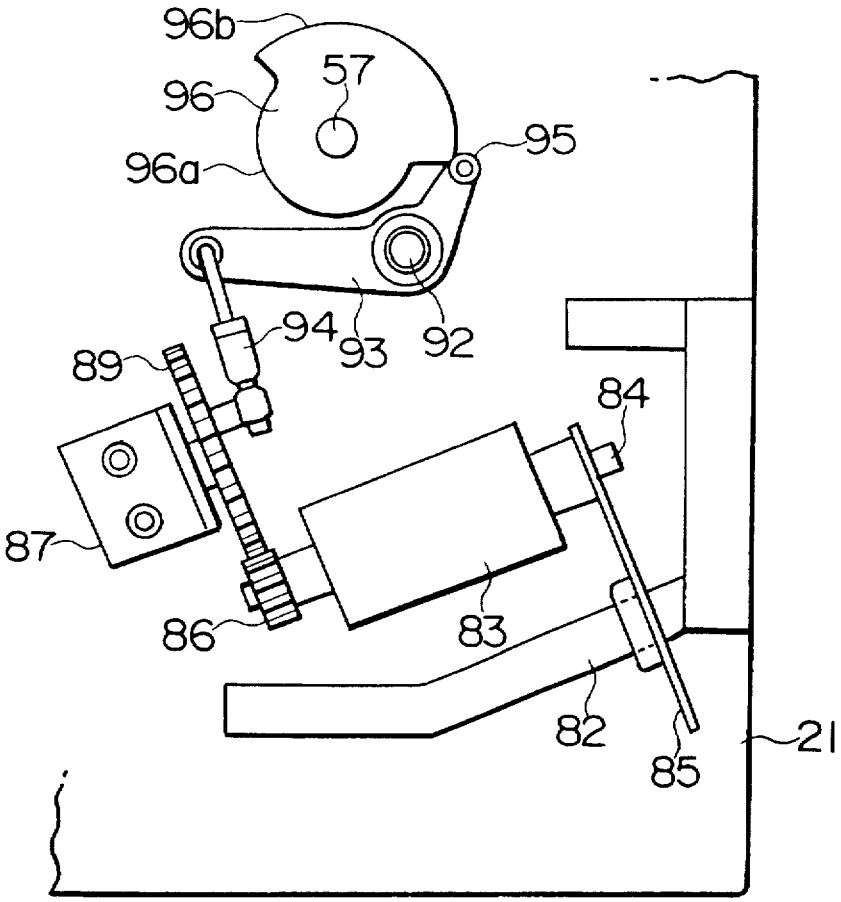
FIG.19 is a schematic side view illustrating holding means corresponding to FIG. 20.

The rotational shaft 57 is further rotated from this state in the same direction as that described above. When the supporting arm 58 is rotated to the position where the capturing piece 64 passes through the first end of the guide plate 82, the second cam 96 is brought into the state where engagement between the circular surface 96*a* thereof and the cam follower 95 is released. When the rotational shaft 57 is further rotated, the cam follower 95 engages the circular surface 96*b*, as shown in FIG. 19. The state where the cam follower 95 engages the circular surface 96*b* is then maintained. The capturing piece 64 which captures the sliver S is moved with the rotation of the supporting arm 58, and the silver S is at the position where the sliver S connects the feed roller 15 and the capturing piece 64.

Figure 20:
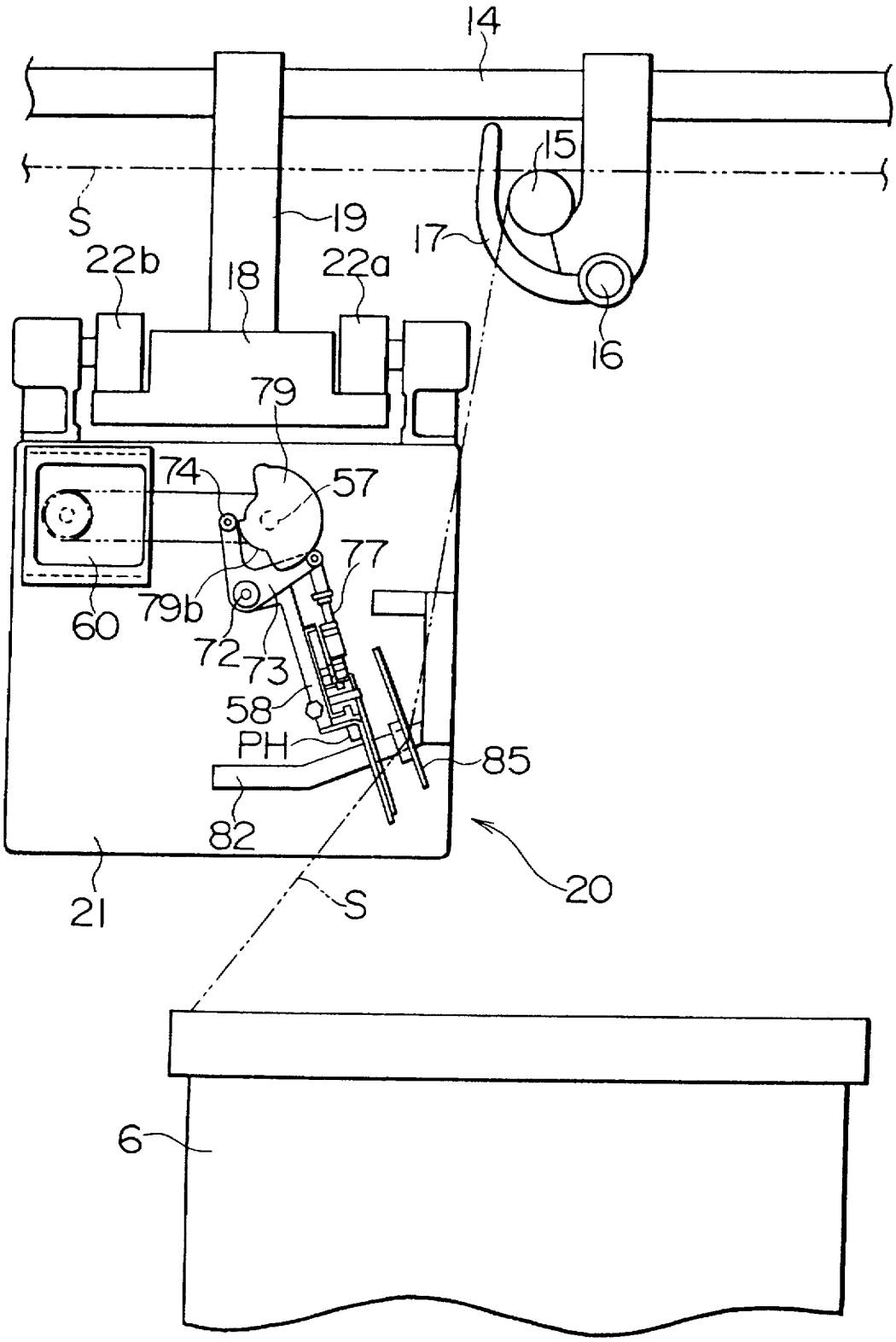
FIG. 20 is a schematic side view illustrating the operation of a sliver cutting unit.

During the rotation of the second cam 96 from the position where the cam follower 95 engages the circular surface 96*a* to the position where the cam follower 95 engages the circular surface 96*b*, the second cam lever 93 is rotated in the counterclockwise direction in FIG. 15. The rotation of the second cam lever 93 causes rotation of the driving gear 89 through the connecting rod 94, and the rotation of the driving gear 89 causes rotation of the second holding lever 85 together with the driven gear 86. The second holding lever 85 is then at the holding position, as shown in FIGS. 19 and 20. The second holding lever 85 is rotated 180 degrees from the standby position. In the course of rotation, the second holding lever 85 engages the sliver S which extends from the feed roller 15 to the capturing piece 64. At the holding position, the second holding lever 85 holds the sliver S in cooperation with the guide plate 82.

When the rotational shaft 57 is further rotated from the state shown in FIG. 20, the cam follower 74 engages the circular surface 79*c*. During the rotation of the first cam lever 73 from the position where the cam follower 74 engages the circular surface 79*b* to the position where the cam follower 74 engages the circular surface 79*c*, the driving gear 70 is again rotated in the same direction through the connecting rod 77. The first holding lever 71 is rotated to the holding position shown in FIG. 22 from the capture position together with the driven gear 68. On the other hand, the second cam 96 is rotated in the state where the circular surface 96*b* thereof engages the cam follower 95, and the second holding lever 45 is maintained at the holding position shown in FIG. 19. When the first holding lever 71 is at the holding position, the distance between the second holding lever 85 and the first holding lever 71 is greater than the fiber length of the sliver S.

Figure 21:
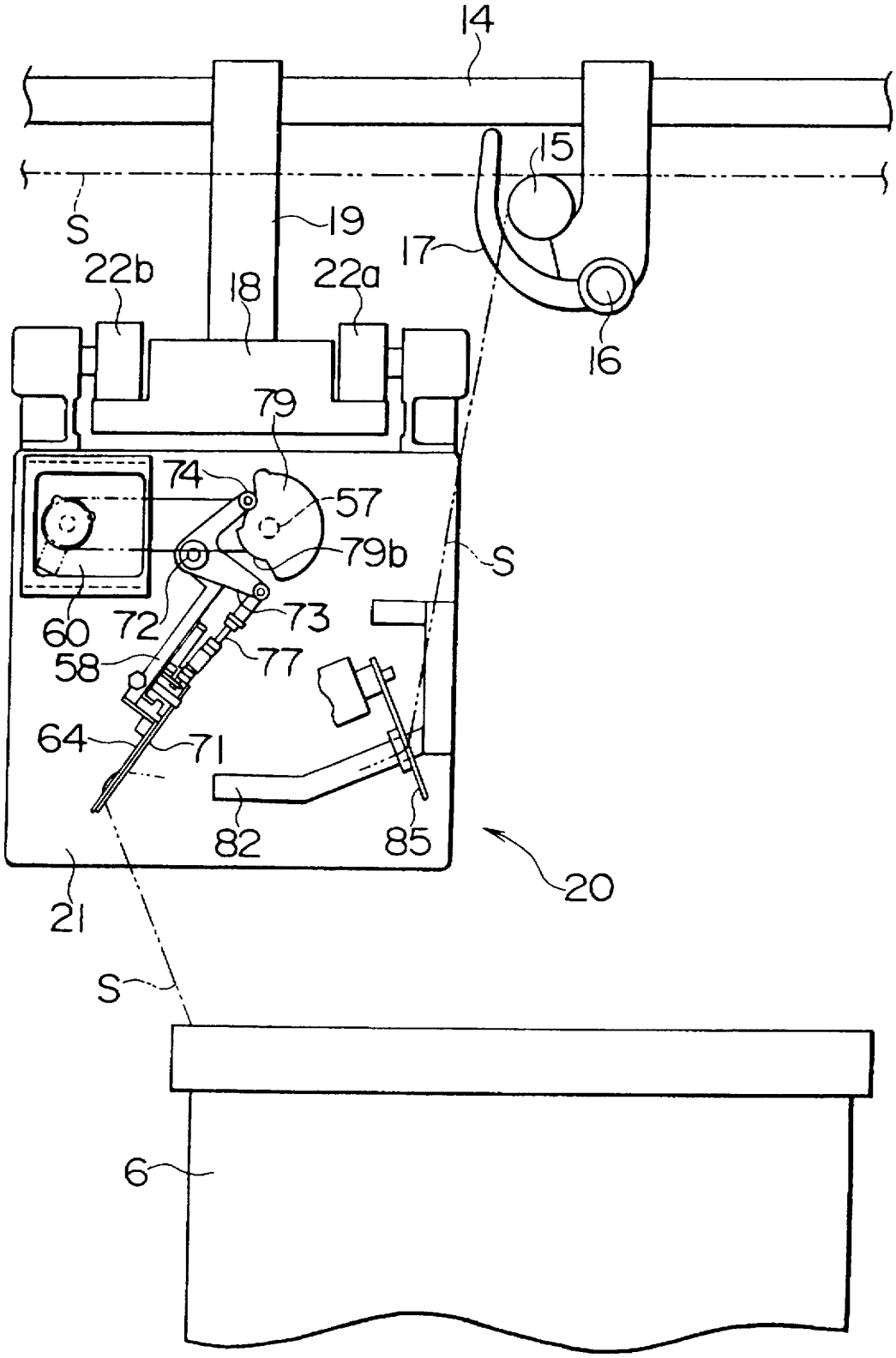
FIG. 21 is a schematic side view illustrating the operation of a sliver cutting unit.
Figure 22:
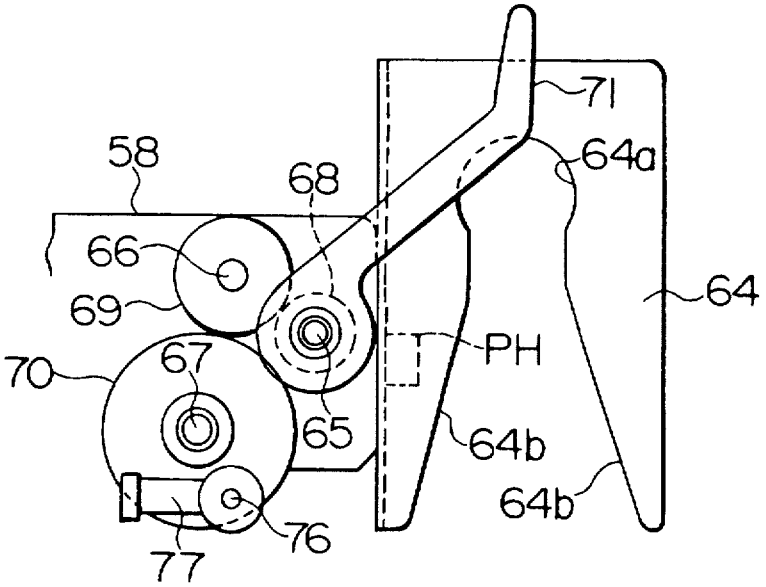
FIG. 22 is a schematic front view illustrating a relation between a first holding lever and a capturing member corresponding to FIG. 21.

After the rotational shaft 57 is continuously rotated after the first holding lever 71 is at the holding position, the rotational shaft 57 is stopped in the state where the capturing piece 64 is at a distance between the first holding lever 71 and the second holding lever 85, which is sufficiently longer than the fiber length of the sliver S, as shown in FIG. 21. During this time, the sliver S held at two positions by the first holding lever 64 and the second holding lever 85 is cut by extending the distance between both holding positions. In the state where the rotational shaft 57 is stopped, i.e., in the state where the supporting arm 58 is stopped, the cam follower 74 engages the circular surface 79*c*, and the first holding lever 71 holds the cut end of the sliver S, as shown in FIG. 21.

The sliver S is first held by the second holding lever 85, and is then held by the first holding lever 71. Thus, even if the sliver S is drawn when the second holding lever 85 is moved to the holding position, the sliver S is not drawn on the side of the feed rollers 15 because the silver S freely moves on the side of the cans 6. When the first holding lever 71 which holds the sliver S is moved, the sliver S is also not drawn on the side of the feed rollers 15.

When the motor 60 is then reversely rotated, the rotational shaft 57 is rotated in the clockwise direction in FIG. 21, and the supporting arm 58 and the second cam 96 are also rotated in the clockwise direction in FIG. 21 integrally with the rotational shaft 57. The motor 60 is continuously driven until the supporting arm 58 reaches the capture start position. In the course of rotation of the supporting arm 58 to the position (shown in FIG. 24) where it is substantially parallel with the second holding lever 85, the engagement between the cam follower 74 and the circular surface 79*c* is terminated. When the supporting arm 58 reaches the position shown in FIG. 24, the cam follower 74 engages the circular surface 79*b*. As a result. the first holding lever 71 is at the capturing position shown in FIG. 18, and the cut end of the sliver S which is held by the first holding lever 71 and the capturing piece 64 is released and falls into the can 6 by its own weight.

Figure 23:
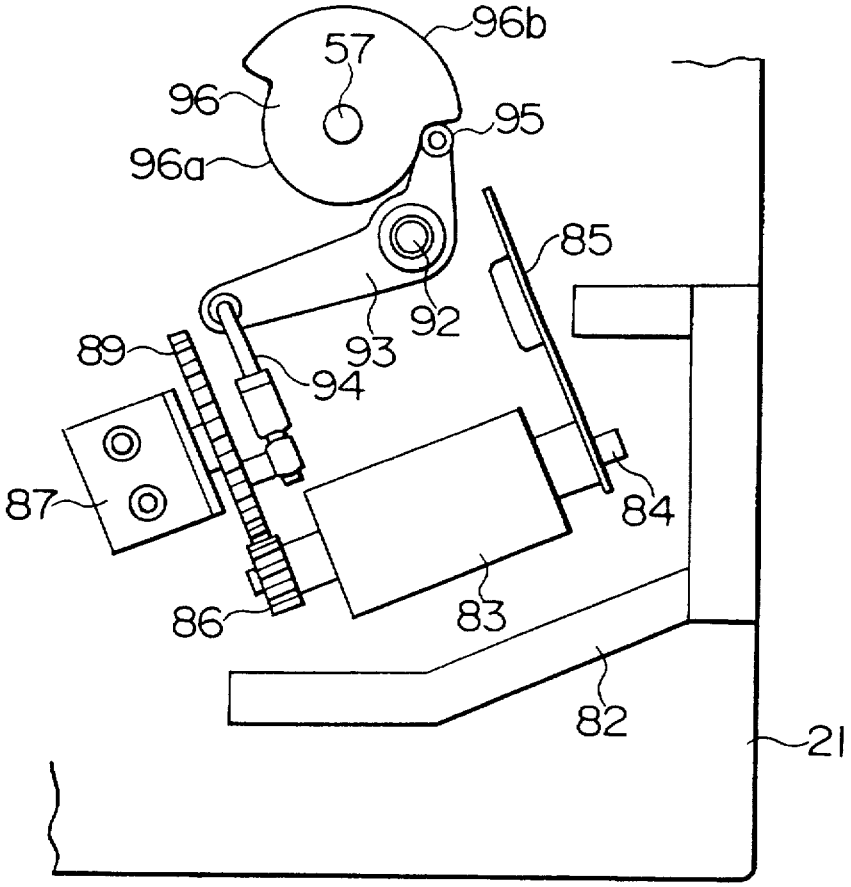
FIG. 23 is a schematic side view illustrating second holding means corresponding to FIG. 24.
Figure 24:
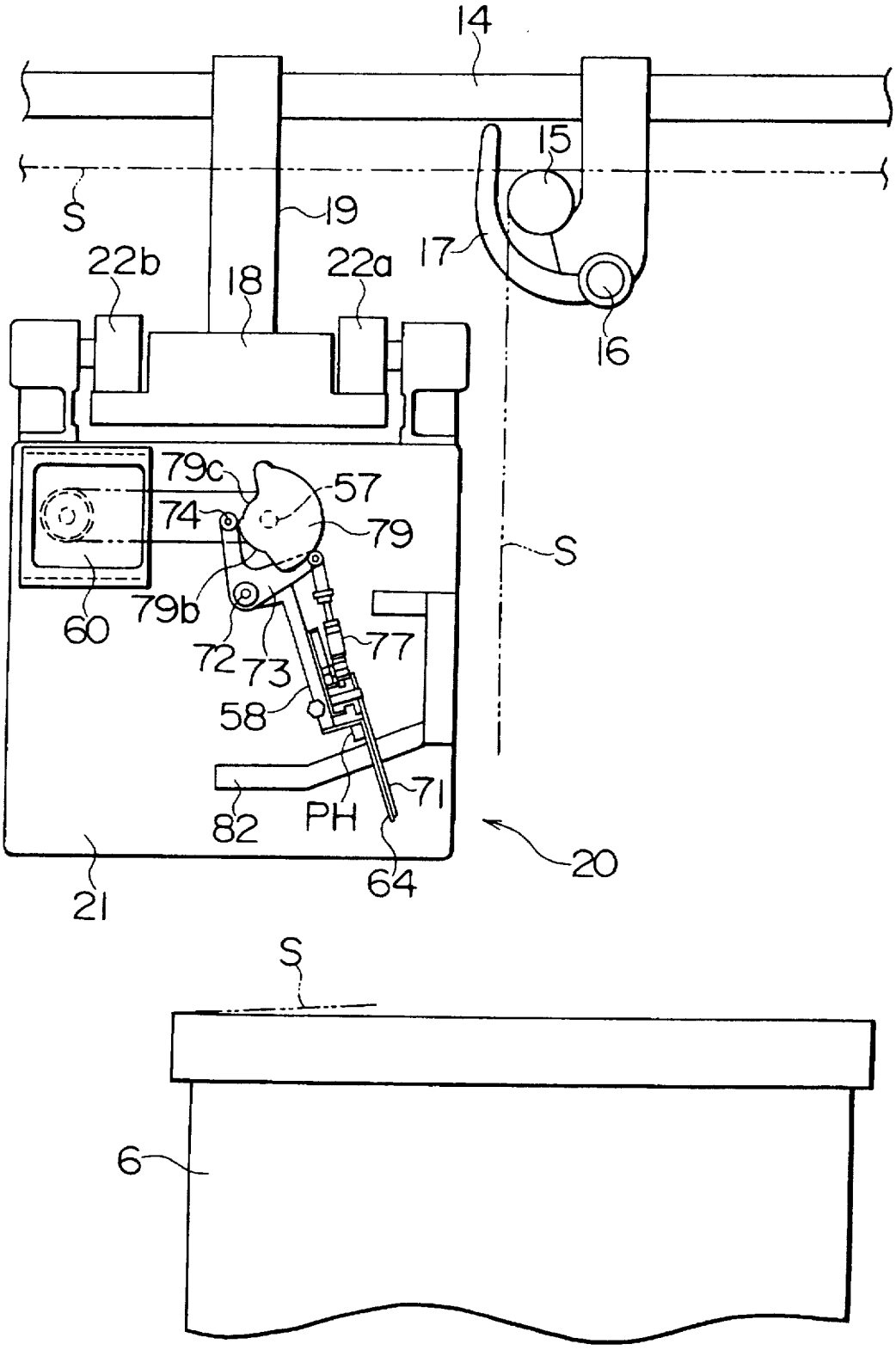
FIG. 24 is a schematic side view illustrating the operation of a sliver cutting unit.

On the other hand, the cam follower 95 is moved from the state of engagement with the circular surface 96*b* to the state of engagement with the circular surface 96*a* shown in FIG. 23. During this time, the second cam lever 93 is rotated in the counterclockwise direction in FIG. 19, and the second holding lever 85 is at the standby position where the holding of the sliver S is released. If the sliver cutting position is close to the corresponding feed roller 15, since the gravity acting on the portion of the sliver S which extends from the feed roller 15 toward the roving frame 1 is greater than that acting on the end of the cut sliver S, the sliver slips down the feed roller 15. However, since the cutting position of the set sliver is at a predetermined distance or more from the feed roller 15, the sliver S hangs vertically from the feed roller 15 by its own weight. When the supporting arm 58 is then further rotated clockwise, it returns to the capture start position.

In this way, one cycle of the sliver cutting work is completed. The sliver piecing machine 20 is then moved to the position corresponding to a next set sliver S. The sliver piecing machine 20 is then moved along the traveling rail 18 and performs the sliver cutting work at the position opposite to the sliver S to be cut in the same way as that described above. After the all set slivers S of the can rows corresponding to the traveling rail 18 are completely cut, the sliver piecing machine 20 is stopped at the predetermined position on the second end side of the traveling rail 18 and waits at the position. The sliver piecing machine 20 is stopped when the detection sensor (not shown) provided on the sliver piecing machine 20 detects the detected member (not shown) provided at the predetermined position on the traveling rails 18. The motor 60 is stopped in the state where the supporting arm 58 is at the position shown in FIG. 21, i.e., the state where the capturing piece 64 and so on cannot engage the sliver S.

The empty cans 6B for which the set sliver cutting work is completed are then replaced by the full sliver cans 6F. The full sliver cans 6F are at positions corresponding to the slivers S (referred to as "old sliver S1" hereinafter) which respectively hang from the feed rollers 15. At the start of can replacement, no empty can 6B is present in the empty can stock portion 11. The full sliver cans 6F for one row of sliver supply cans are stocked on the can conveyance unit 2*e*.

The replacement of the can row on the can conveyance unit 2*a* is described as an example. The cans replaced by operations of the can conveyance units 2*e*, 3, 4 and 12 and the pressure device 10*a*. The full sliver cans 6F are successively loaded on the can conveyance unit 3 by operation of the can conveyance unit 2*e*, and are conveyed by the can conveyance unit 3 to the position corresponding to the can conveyance unit 2*a*. The full sliver cans 6F which reach the position corresponding to the can conveyance unit 2*a* are maintained in the state where movement in the lengthwise direction of the can conveyance unit 3 is inhibited by a stopper (not shown). In this state, the full sliver cans 6F are pushed onto the can conveyance unit 2*a* by operation of the pressure device 10*a*. At the same time, the can row on the can conveyance unit 2*a* is pushed to the second end side of the can conveyance unit 2*a* through the full sliver cans 6F, and the cans on the second end side are loaded on the can conveyance unit 4. The empty cans 6B which have been moved onto the can conveyance unit 4 are conveyed by the can conveyance unit 4 to the empty can stock portion 11, and loaded on the can conveyance unit 12. The empty cans 6B are then conveyed on the can conveyance unit 12 to the first end side.

After the full sliver cans 6F for one row are completely pushed to the can conveyance unit 2*a* by the pressure device 10*a*, the operations of the can conveyance units 2*e* and 3 are stopped. The full sliver cans 6F are detected by a sensor (not shown) provided near the pressure device 10*a* so that the number of operations of the pressure device 10*a* is counted by a counter. After the number of the empty cans 6B which is counted on the basis of a detection signal of a sensor (not shown) which is provided at a position of the empty can stock portion 11 corresponding to the can conveyance unit 4 reaches a predetermined value, the can conveyance units 4 and 12 are stopped, and can replacement is completed.

A can replacement completion signal is sent from the host computer HC to the sliver piecing machine 20 through the carrier 25, and the sliver piecing machine 20 starts the sliver piecing work on the basis of this signal. The sliver piecing machine 20 starts to move in the direction opposite to that in the sliver piecing work, and is intermittently stopped at predetermined positions for the sliver piecing work.

The sliver piecing work is described with reference to FIGS. 25 through 32. In FIGS. 25 through 32, the separator 17, the traveling rails 18, the driving rollers 22*a*, the driven rollers 22*b*, the sliver cutting device 27, etc. are not shown.

Figure 25:
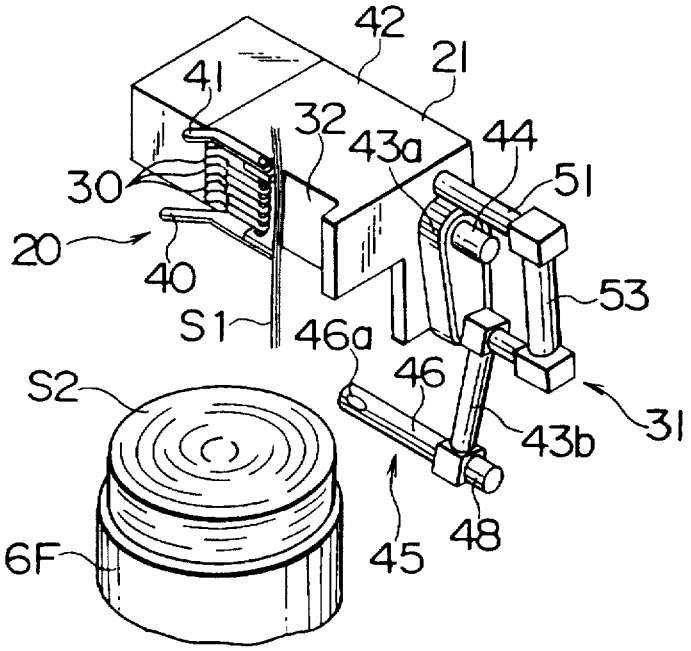
FIG. 25 is a perspective view illustrating the operation of a sliver piecing unit with parts omitted.
Figure 26:
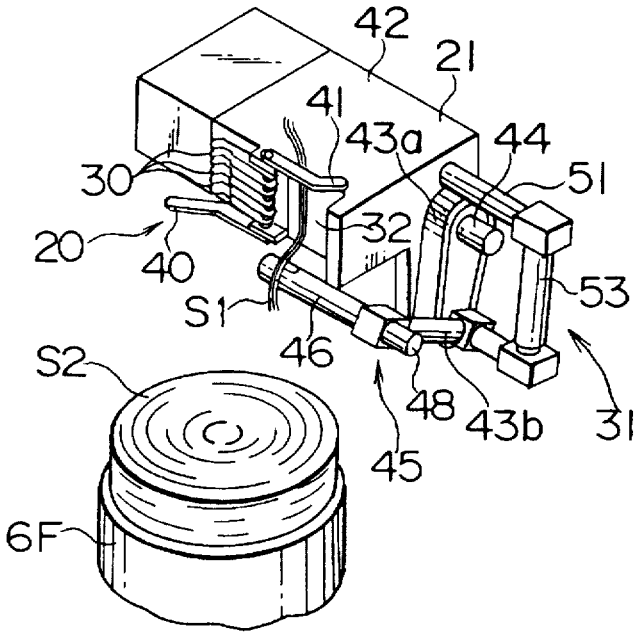
FIG. 26 is a perspective view illustrating the operation of a sliver piecing unit with parts omitted.
Figure 27:
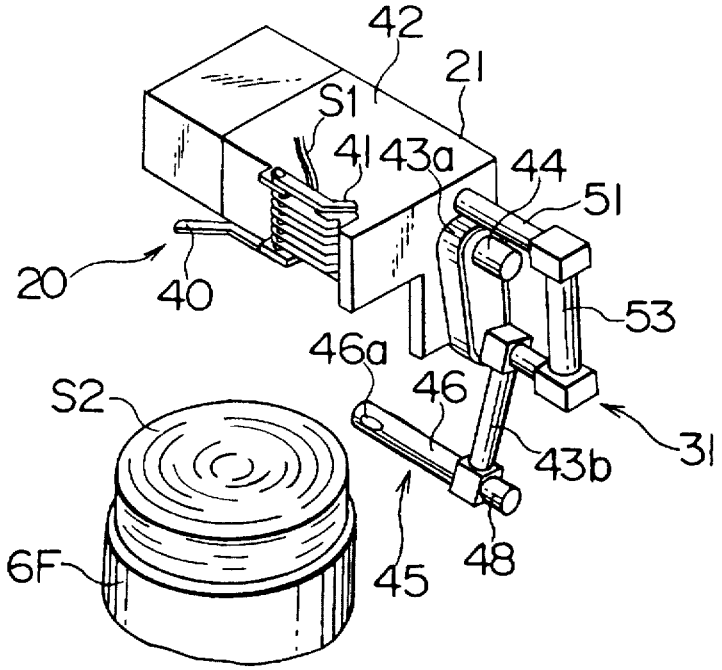
FIG. 27 is a perspective view illustrating the operation of a sliver piecing unit with parts omitted.

At the same time as start of the sliver piecing work, the blower is driven for bringing the inside of the collecting box 42 into negative pressure. When the sliver piecing machine 20 is stopped at the predetermined position, the sliver introduction portion 32 is in a state corresponding to the old sliver S1 which hangs down through the separator 17, as shown in FIG. 25. In this state, the sliver holding arm 31 is driven, and the suction hole 46*a* is placed under the sliver taking-in lever 41 at the position opposite to the old sliver S1 hanging down. Before the suction hole 46*a* is at the position opposite to the old sliver S1, the rotary actuator 48 is started so that the suction pipe 46 is at the position that the suction hole 46*a* is open. After the suction hole 46*a* is at the position opposite to the old sliver S1, the suction pipe 46 is at the closed position. As a result, the old sliver S1 is held by the sliver holding unit 45 with a portion thereof drawn into the suction pipe 46. The sliver taking-in lever 41 is then operated in the state where the sliver holding unit 45 is placed under and near the sliver introduction portion 32 by driving the sliver holding arm 31 so that the old sliver S1 is introduced into the sliver introduction portion 32, as shown in FIG. 26.

The sliver holding arm 31 is driven so that the sliver holding unit 45 is downwardly moved, and the old sliver S1 is cut between the sliver taking-in lever 41 and the sliver holding unit 45. At the same time, the sliver presser 30 is driven to push the sliver between the needles 34*a*, shown in FIG. 6, and prevent dropping of the sliver from the sliver introduction portion 32. The suction pipe 46 is then at the open position so that the sliver cut end held by the sliver holding unit 45 is drawn into the suction pipe 46 (the state shown in FIG. 27. The sliver cut end is recovered by the collecting box by suction of the collecting box 42 through the second arm 43*b*, the bellows hose 53, the pipe 51 and the hose 52. Before the sliver presser 30 is operated, the cam 39 of the sliver piecing unit 29 is rotated to the position where the large diameter portion 39*a* thereof engages the cam follower 37*a*, the needles 34*a* are maintained in the state where the needles 34*a* enter between the separate plates 33.

Figure 28:
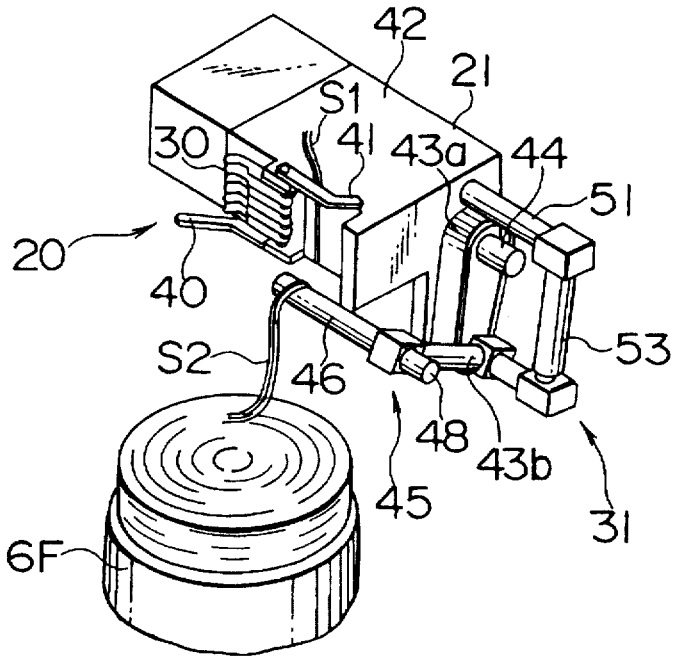
FIG. 28 is a perspective view illustrating the operation of a sliver piecing unit with parts omitted.

The sliver holding arm 31 is then driven to move the sliver holding unit 45 to the position where the suction hole 46 is opposite to the end of the sliver (referred to as "new silver" hereinafter) of the corresponding full sliver can 6F. Since the sliver end of the full sliver can 6F hangs down from the upper portion of the full sliver can 6F at a predetermined position thereof, the end of the new sliver S2 is drawn by the suction hole 46*a*. When the suction pipe is then brought into the closed state, the sliver end is held by the suction pipe 46 and the supporting cylinder 47. When the sliver holding arm 31 is then driven so that the sliver holding unit 45 is upwardly moved, the sliver holding unit 45 lifts the new sliver S2, as shown in FIG. 28.

Figure 29:
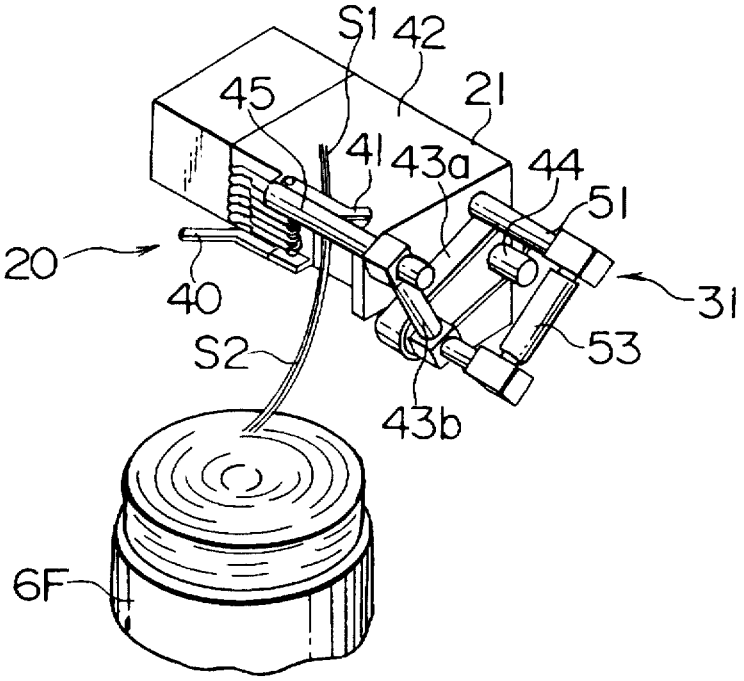
FIG. 29 is a perspective view illustrating the operation of a sliver piecing unit with parts omitted.
Figure 30:
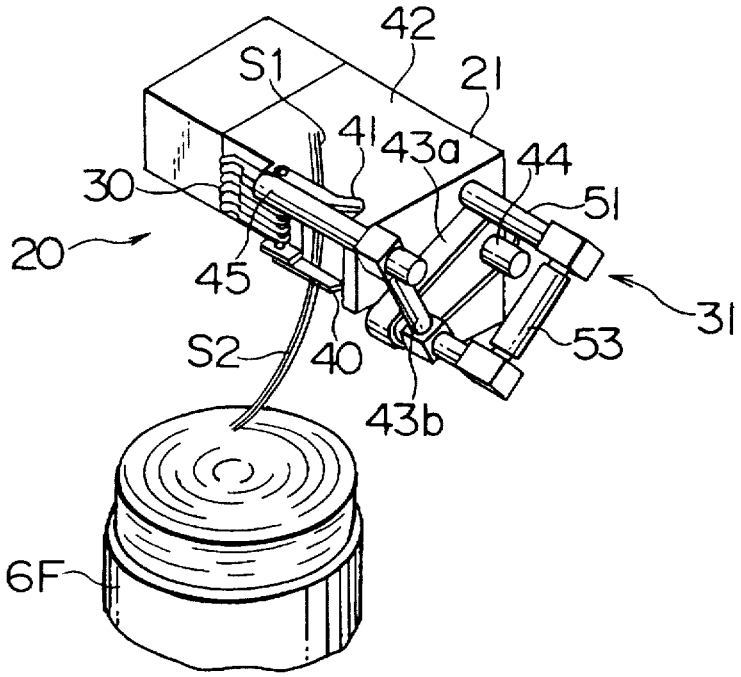
FIG. 30 is a perspective view illustrating the operation of a sliver piecing unit with parts omitted.

The sliver presser 30 is then rotated to the release position. In this state, the sliver holding unit 45 is further upwardly moved, and the silver holding arm 31 is stopped when the sliver holding unit 45 is at the predetermined position above the sliver taking-in lever 41, as shown in FIG. 29. The sliver taking-in lever 40 is then rotated to the holding position, and the new sliver S which extends from the sliver holding unit 45 to the full sliver can 6F is introduced into the sliver introduction portion 32. The sliver holding unit 45 is then upwardly moved by driving the sliver holding arm 31 so that the new sliver S2 held by the sliver holding unit 45 is cut between the sliver taking-in lever 40 and the sliver holding unit 45. At the same time, the sliver presser 30 is driven to push the sliver between the needles 34*a* shown in FIG. 6 for preventing the sliver from dropping from the sliver introduction portion 32. In this way, the end of the new sliver S2 to be newly supplied from the full sliver can 6F and the end of the old sliver S1 which was previously cut are overlapped. The suction pipe 46 is set to the open position so that the sliver cut end held by the sliver holding unit 45 is drawn into the suction pipe 46 and is recovered by the collecting box 42.

Figure 31:
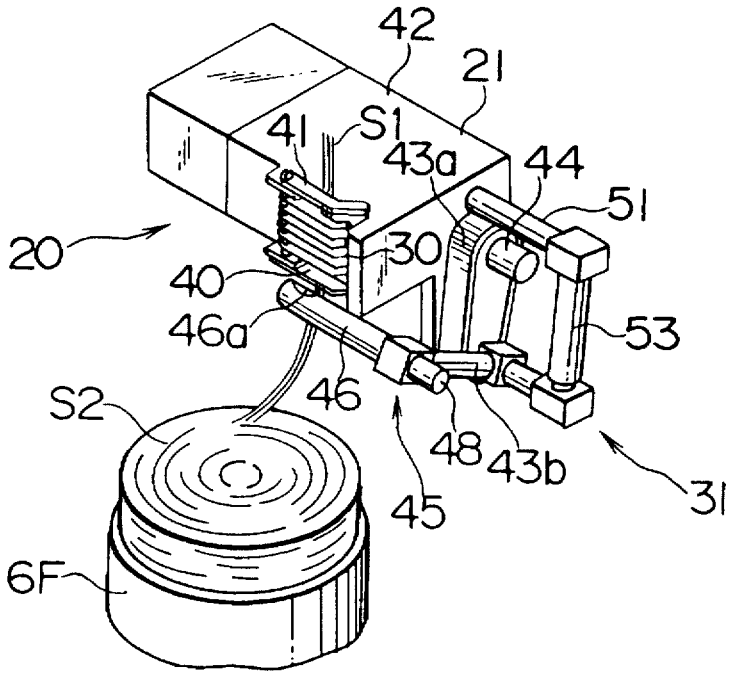
FIG. 31 is a perspective view illustrating the operation of a sliver piecing unit with parts omitted.

The sliver piecing unit 29 is then operated in the state shown in FIG. 31, and the needle plate 34 is reciprocated several times (in this embodiment, twice). The needles 34 are caused to enter between the separate plates 33 by reciprocation of the needle plate 34 so as to pierce the overlapped portions of the slivers S1 and S2 which are held by the separate plate 33 and the sliver presser 30. The needles 34*a* which pierce the slivers S1 and S2 are removed by backward movement of the needle plate 34. As a result, the fibers of the slivers S1 and S2 which are overlapped are tangled to join the slivers S1 and S2 together.

Figure 32:
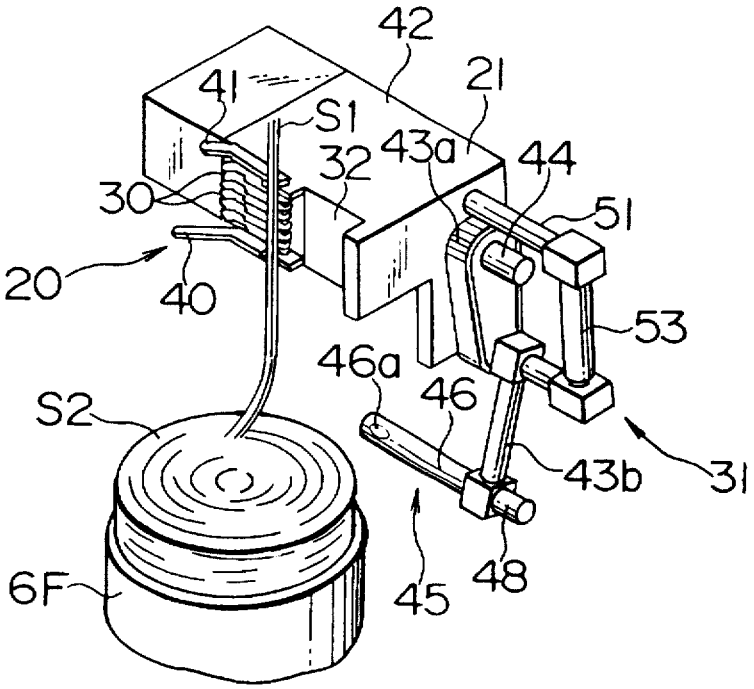
FIG. 32 is a perspective view illustrating the operation of a sliver piecing unit with parts omitted.

After the work of piecing the slivers S1 and S2 together has been completed by the sliver piecing unit 29, when the sliver taking-in levers 40 and 41 and the sliver presser 30 are rotated to the release position, the slivers S1 and S2 are released from the sliver introduction portion 32, as shown in FIG. 32. The sliver piecing machine 20 is then moved to the next working position and performs the same sliver piecing work as that described above.

When the sliver piecing machine 20 completes all sliver piecing works for the full sliver cans 6F corresponding to the traveling rail 18 and returns to the carrier 25, a completion signal for the silver piecing work is output from the carrier 25 to the host computer HC. When receiving the sliver piecing work completion signal, the host computer HC outputs a command signal to the roving frame 1 to resume the operation, and the operation of the roving frame 1 is resumed. The carrier 25 waits at the predetermined position until a command is output from the host computer HC to the carrier 25 to move to the can row for which the sliver piecing work is required. In addition, all empty cans 6B in the empty can stock portion 11 are conveyed to the drawing frame 5 by the next can replacement, and the full sliver cans 6F of sliver supplied from the drawing frame 5 are arranged in a row on the can conveyance unit 2*e*.

The completion of the sliver piecing work may be confirmed by a signal from a sensor for detecting that the sliver piecing machine 20 reaches a predetermined position of the traveling rail 18 on the first end side thereof in place of the method of confirming by return of the sliver piecing machine 20 to the carrier 25.

On the sliver piecing work, since the cut old sliver S1 hangs down from the corresponding feed roller 15 at the predetermined position opposite to the center of the corresponding full sliver can 6F, as described above, the old sliver S1 can easily be introduced into the sliver piecing unit 29. The sliver holding arm 31 need not to be moved to a position far away from the center of the full sliver can 6F, thereby decreasing the sizes of the sliver holding arm 31 and the driving unit thereof.

Further, since the sliver cutting work and the sliver piecing work are separately performed, the empty can row can be replaced by the full can row between the sliver cutting work and the sliver piecing work.

Embodiment 2

Figure 33:
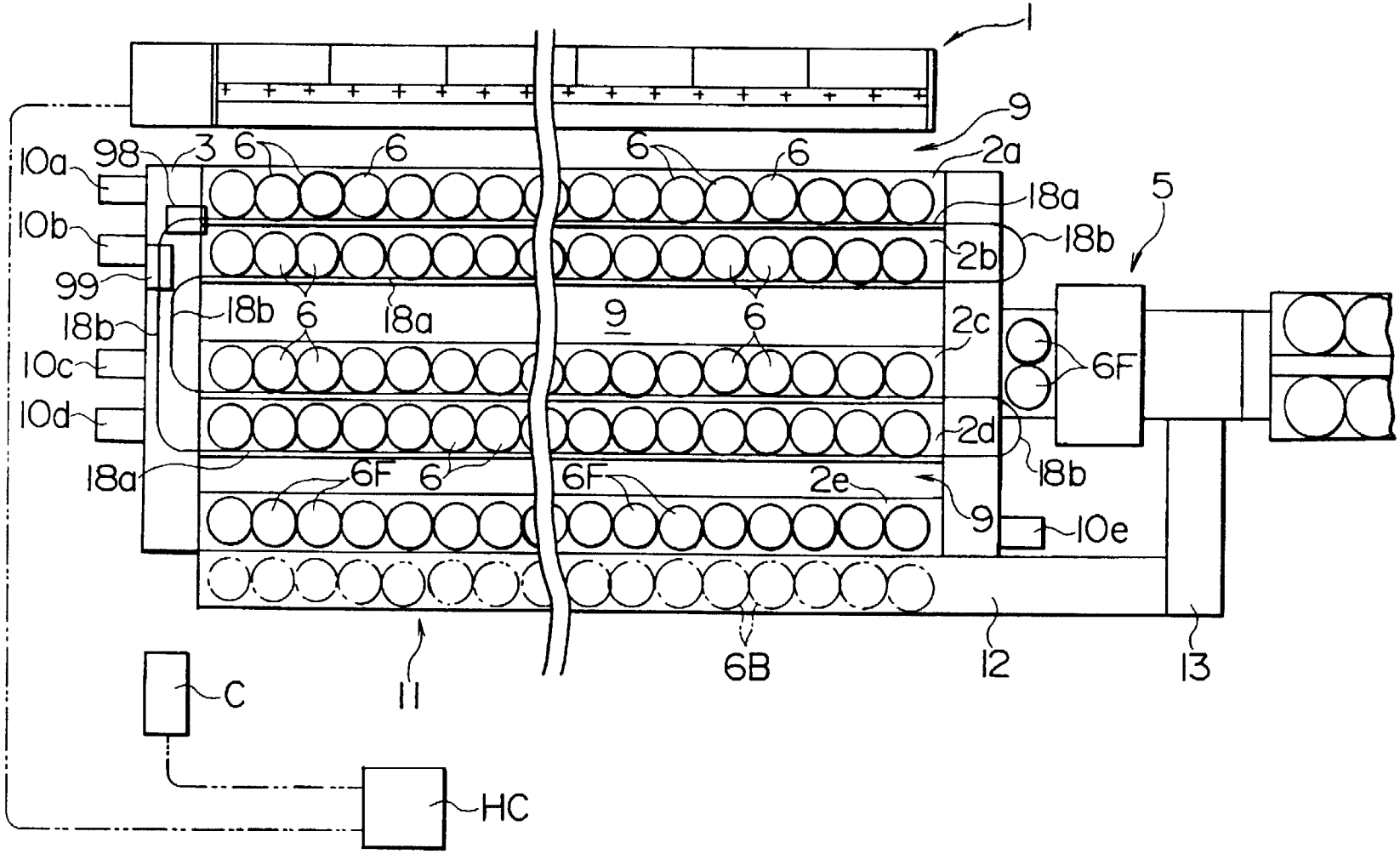
FIG. 33 is a schematic plan view illustrating relations among a roving frame, a traveling rail, a sliver piecing machine, etc. in accordance with a second embodiment.

A second embodiment is described below with reference to FIG. 33. This embodiment is significantly different from the first embodiment in the points that the traveling rails provided along the respective can rows are continued, and that a sliver cutting machine and a sliver piecing machine are separately provided on the traveling rails.

More specifically, the traveling rails 18 have straight portions 18*a* extending along the sliver supply can rows and connecting portions 18*b* for connecting the ends of the straight portions 18*a* to form a closed loop. A sliver cutting machine 98 and a sliver piecing machine 99 are independently movably provided as automatic machines on the traveling rail 18. The silver cutting machine 98 is provided with a sliver cutting device (not shown) having the same structure as in the first embodiment. The sliver piecing machine 99 is provided with a sliver piecing device (not shown) having the same structure as in the first embodiment. The sliver cutting machine 98 and the sliver piecing machine 99 are configured so that signals can be transmitted between the host computer HC and both machines.

In the system of this embodiment, after the empty can row has been replaced by the full sliver can row, the cut sliver (old sliver) to be pieced with another sliver and the silver (new sliver) of the full sliver can are pieced together. In addition, the roving frame 1 is operated so that the sliver piecing work is performed for the can rows in the order of first-second-third-fourth-first.

The sliver cutting machine 98 and the sliver piecing machine 99 are moved on the traveling rails 18 so as to circulate in a constant direction, the sliver piecing machine 99 being moved following the sliver cutting machine 98. In operation of the roving frame 1, the sliver cutting machine 98 and the sliver piecing machine 99 wait at predetermined positions on one of the connecting portions 18*b* of the traveling rails 18. After the sliver can under spinning is substantially emptied, and the operation of the roving frame 1 is stopped, the sliver cutting machine 98 is first started to move by the command signal from the host computer HC.

The sliver cutting machine 98 is moved on the traveling rail 18 along each of the can rows to cut the old sliver which extends from each of the cans 6 to the roving frame 1 by the sliver cutting device so that the sliver end freely hangs down. After all old slivers for one row have been completely cut, when the sliver cutting machine 98 reaches the predetermined position, the sliver cutting work completion signal is output to the host computer. When receiving the sliver cutting work completion signal, the host computer HC outputs a can replacement signal to the can conveyance controller C. The work of replacing the empty can row is then replaced by the full sliver can row by the same method as that described above.

After completion of the can replacement work, the sliver piecing machine 99 starts the sliver piecing work by the command from the host computer HC. The sliver piecing machine 99 pieces the cut sliver and the sliver of the full sliver can 6F by the sliver piecing device. After the sliver piecing work for one row has been completed by the sliver piecing machine 99, when the sliver piecing machine 99 reaches the predetermined position, the sliver piecing completion signal is output. The operation of the roving frame 1 is then resumed by the command from the host computer HC. On the other hand, the sliver cutting machine 98 and the sliver piecing machine 99 wait on one of the connecting portions 18*b*.

In this embodiment, the sliver cutting device and the sliver piecing device are not provided on a single automatic machine, but two automatic machines, i.e., the sliver cutting machine 98 and the sliver piecing machine 99, are separately provided. The size of each of the automatic machines can thus be decreased, thereby facilitating the movement of the automatic machines without interference with the slivers even if the distance between the upper portions of the cans 6 and 6F and the traveling rails 18 is small.

Further, in the construction of this embodiment, since the sliver cutting machine 98 and the sliver piecing machine 99 are independent, it is possible to significantly decrease the working time for changing the kind of the spun sliver. This is because the work of changing the kind of the spun sliver requires the sliver piecing work and the can replacing work for all can rows, and the sliver cutting work and the can replacing work before the sliver piecing work by the sliver piecing device. When the sliver cutting device and the sliver piecing device are mounted on a single automatic machine, however, since the sliver cutting work, the sliver replacing work and the sliver piecing work must be successively performed for each of the can rows, all works cannot be performed concurrently. However, in the construction of this embodiment, after the sliver cutting work has been performed for one can row, the sliver cutting machine 98 can perform the sliver cutting work for another can row regardless of the sliver can replacing work and the sliver piecing work for the one can row. The can replacing work can also be performed regardless of the sliver piecing work. The works can thus be performed concurrently, thereby significantly decreasing the working time. When the kind of the spun sliver is changed, cans are replacing by using the full sliver cans 6F which are previously prepared in another stock place.

Embodiment 3

Figure 34:
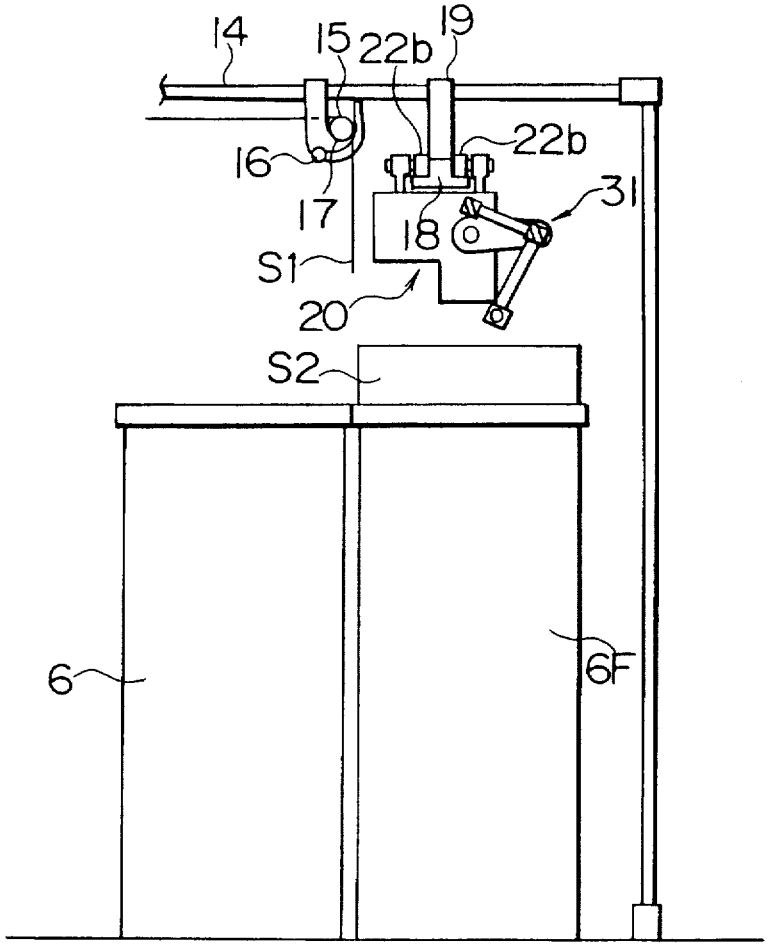
FIG. 34 is a schematic plan view illustrating relations among a traveling rail, a sliver piecing machine, etc. in accordance with a third embodiment.

A third embodiment is described below with reference to FIG. 34. This embodiment is significantly different from the above embodiments in the point that the sliver piecing work is carried out in the state where a sliver can row under spinning and a full sliver can row in reserve are arranged adjacent to each other.

A traveling rail 18 is provided for each pair of the sliver can row under spinning and the full sliver can row in reserve. The carrier 25 and the sliver piecing machine 20 are configured as in the first embodiment.

The sliver piecing machine 20 performs the sliver cutting work while forwardly moving in the same way as in Embodiment 1. After completion of the sliver cutting work, the sliver piecing machine 20 immediately starts to backwardly move toward the first end side of the traveling rails 8 and performs the silver piecing work without waiting at the second end. After the sliver piecing work has been completed for one can row by the sliver piecing machine 20, the operation of the roving machine 1 is resumed. The empty can row is replaced by the full sliver can row before the next sliver piecing work for the corresponding can row.

Figure 35:
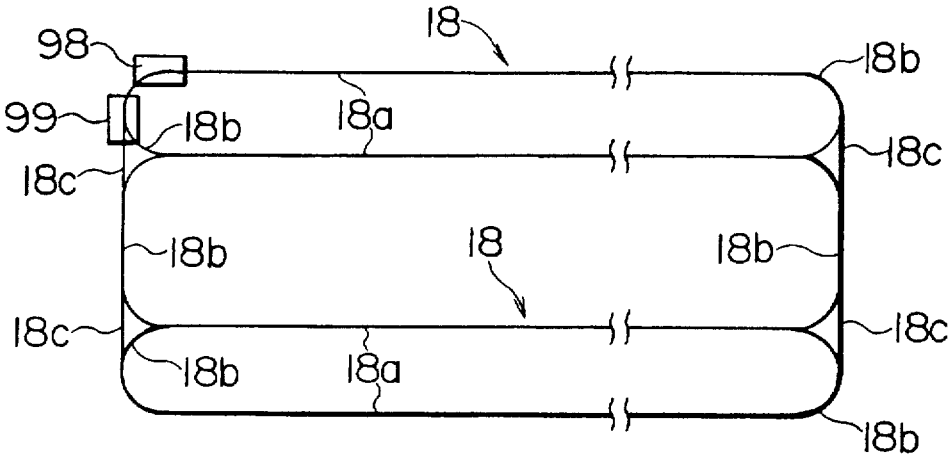
FIG. 35 is a schematic plan view illustrating a traveling rail in accordance with a modified embodiment.

The present invention is not limited to the first and third embodiments. For example, the connecting portions 18*b* for connecting both ends of the adjacent straight portions 18*a*, and the connecting portions 18*c* for connecting the connecting portions 18*b* may be provided on the trailing rails 18, as in Embodiment 2 shown in FIG. 35. In this case, the sliver cutting machine 98 and the sliver piecing machine 99 can freely be moved to a position corresponding to any desired can row. Thus, the order of the sliver piecing work for the can rows can arbitrarily be set.

In Embodiment 2, the traveling rail 18 may be provided for each of the can rows, and the sliver cutting machine 98 and the sliver piecing machine 99 may be moved between the respective traveling rails 18 by the carrier 25, as in Embodiment 1. In this case, the carrier 25 is equipped with two pairs of bridge rails so that the sliver cutting machine 98 and the sliver piecing machine 99 are moved between the traveling rails and the carrier 25 through the respective bridge rails. After the sliver cutting machine 98 performs the sliver cutting work and returns to the carrier 25, the sliver piecing machine 99 performs the sliver piecing work after completion of can replacement. Alternatively, a standby position for the sliver cutting machine 98 may be provided on the second end side of the traveling rails 18 so that when the sliver piecing machine 99 is moved toward the carrier 25, the sliver cutting machine 98 is moved following the sliver piecing machine 99 and returns to the carrier 25.

In Embodiment 3, the traveling rails 18 may be formed in a closed loop, as in Embodiment 2. In this case, the sliver piecing machine 20 enters, from the side of the sliver cutting device, the straight portion corresponding to the can row for which the sliver piecing work is required, and is stopped at the position corresponding to each of the cans to perform the sliver cutting work and the sliver piecing work by the sliver cutting device and the sliver piecing device, respectively. If the distance between the sliver cutting device 27 and the sliver piecing device 28 is the same as the arrangement pitch of the cans, the sliver cutting work and the sliver piecing work can be performed concurrently, thereby decreasing the time to the completion of the sliver piecing work for one row. In addition, the sliver cutting work and the sliver piecing work can be completed only by moving the sliver piecing machine 20 on the traveling rail 18 corresponding to the sliver can rows in one direction. The sliver cutting machine 98 and the sliver piecing machine 99 which are the same as those used in Embodiment 2 may be provided in place of the sliver piecing machine 20, along with a closed loop-formed traveling rail 18. In this case, the sliver piecing machine 99 is moved following the sliver cutting machine 98 and performs the sliver piecing work.

The traveling rails 18 may also be used as a suction duct in place of the collecting box 42 provided on each of the sliver piecing machines 20 and 99, and connecting means for connecting with the suction dust may be provided on the sliver piecing machines 20 and 99. In this case, each of the silver piecing machines 20 and 99 can be decreased in size. Further, the sliver holding unit 45 may be formed in a unit which requires no suction means so that the cut sliver ends are disposed of in the empty cans 6B or on the floor.

More specifically, the cut old sliver S1 hangs down from the corresponding feed roller 15, and the full silver can 6F is placed under the old sliver S1. The full sliver can 6F is brought into the state where the end of the new sliver S2 hangs down at the predetermined position near which the silver piecing machine 20 is moved.

Figure 36:
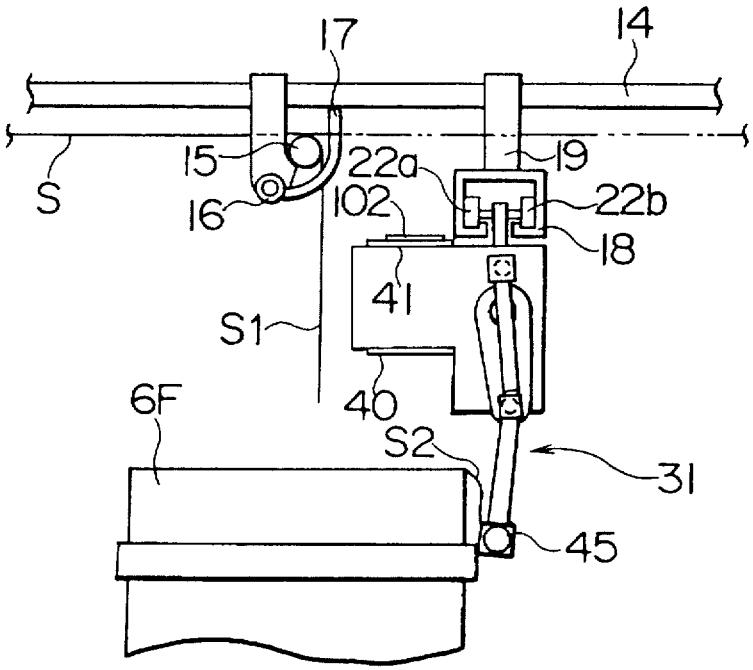
FIGS. 36 to 43 are drawings illustrating the operation of the third embodiment.

The sliver piecing machine 20 waits at the predetermined standby position, and starts the work according to the sliver piecing work command signal output from the controller. The sliver piecing machine 20 is moved on the traveling rails 18 and is stopped at the position opposite to the full silver can 6F for which the sliver piecing work is required. At the start of traveling of the sliver piecing machine 20, the sliver holding arm 31 is at the position where the sliver holding unit 45 can holds the new sliver S2 hanging down from the upper portion of the full sliver can 6F, as shown in FIG. 36. This position is the original position of the sliver holding arm 31. The sliver piecing machine 20 is moved with the sliver holding arm 31 located on the front side in the moving direction thereof.

Figure 45:
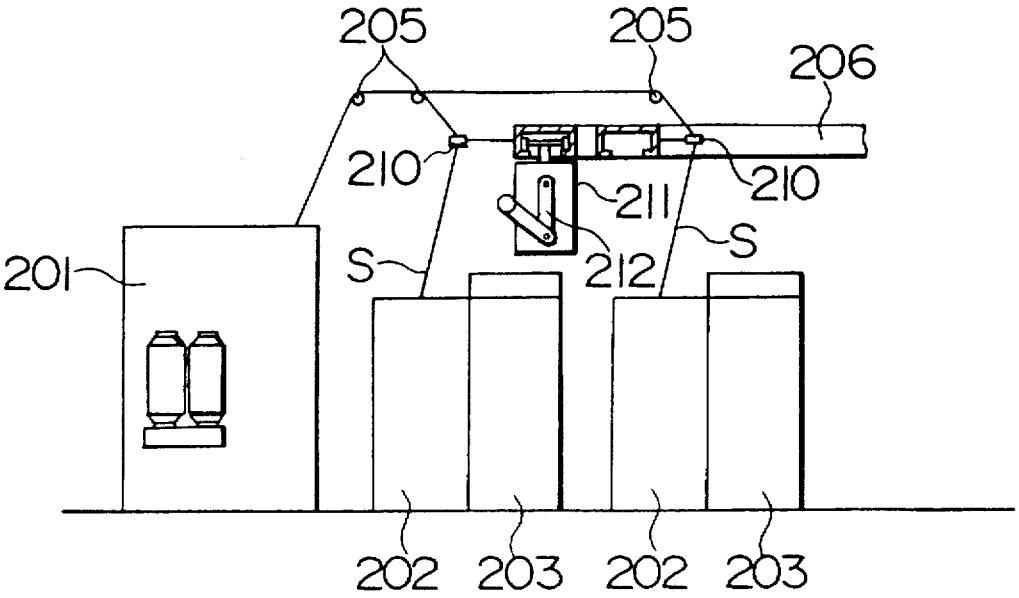
FIG. 45 PRIOR ART
FIG. 45 is a schematic side view illustrating relations among cans, a sliver piecing machine, etc, in another conventional apparatus.

When the sliver piecing machine 20 is stopped at the predetermined position, the new sliver S2 is partially held by the sliver holding unit 45, as shown in FIG. 45.

Figure 37:
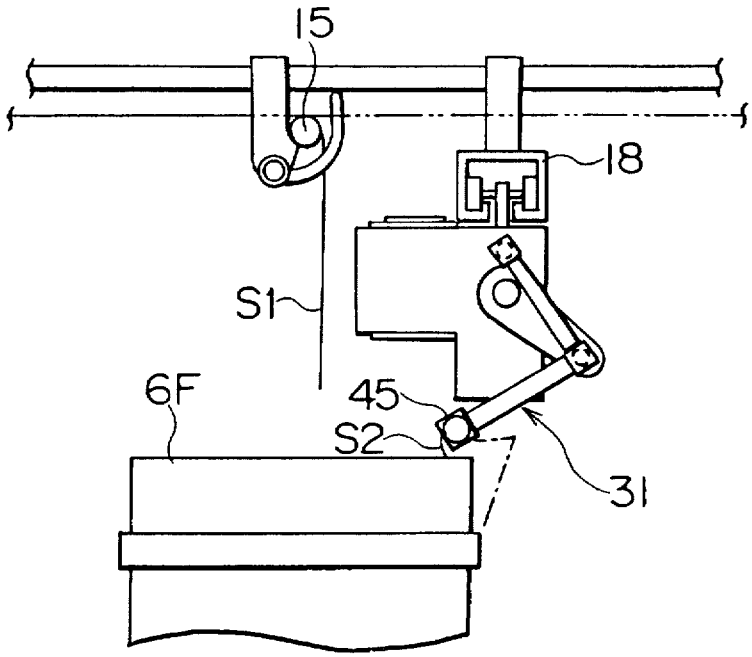

In this state, the sliver holding arm 31 is driven to start to move toward the sliver introduction portion while the new sliver S2 is held by the sliver holding unit 45, as shown in FIG. 37. On the other hand, an additional sliver retracting arm 102 is operated so that the old sliver S1 is maintained at the retracted position without interference with the sliver holding unit 45 before the sliver holding unit 45 reaches the sliver introduction portion of the sliver piecing machine 20, as shown in FIG. 38.

Figure 38:
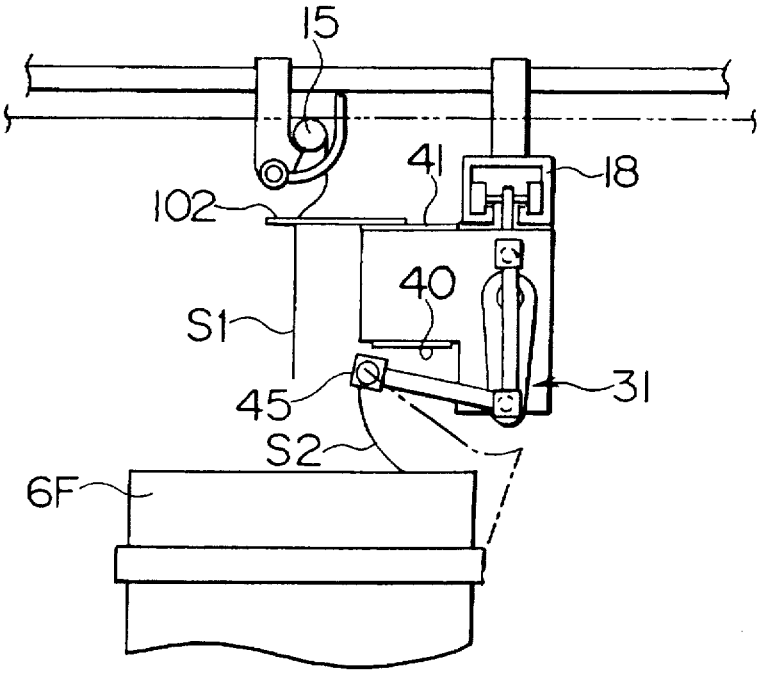
Figure 39:
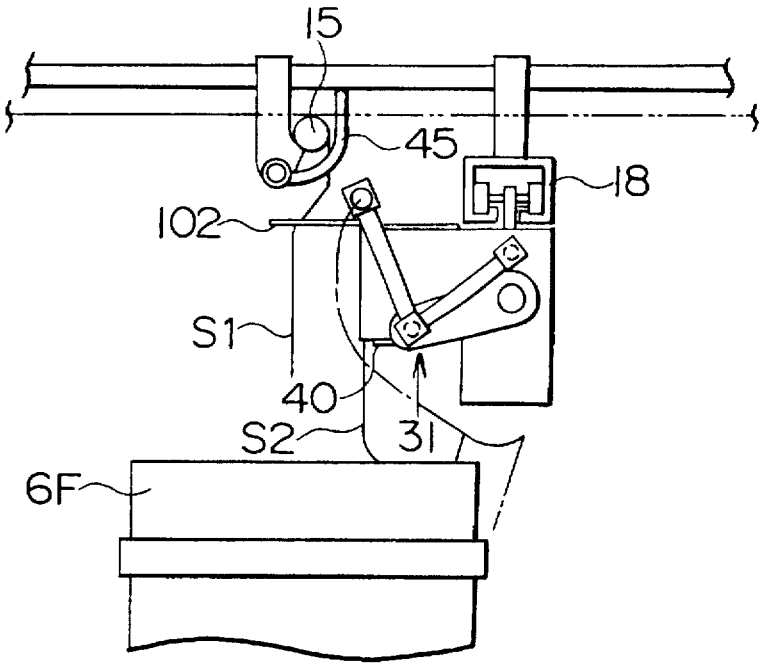

The sliver holding unit 45 is moved from the position shown in FIG. 38 to a position above near the sliver inter portion, as shown in FIG. 39. The silver taking-in lever 40 placed under the sliver introduction portion is then operated to engage the new sliver S2 which hangs down from the silver holding unit 45 and introduce the new sliver S2 into the sliver introduction portion at the operating position. The sliver presser is then at the operating position so that the new sliver S2 is held by the sliver presser and the sliver piecing unit.

Figure 40:
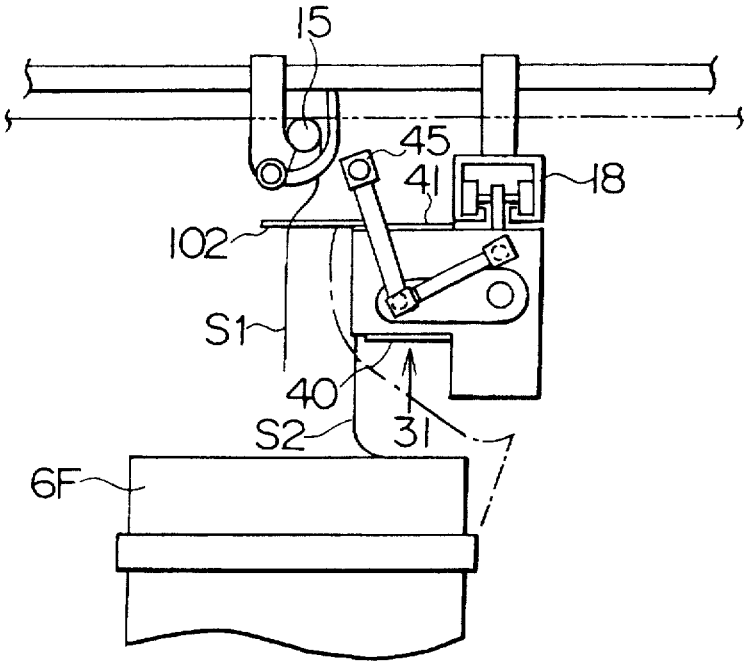

In this state, when the sliver holding unit 45 is further upwardly moved, as shown in FIG. 40, the end of the new sliver S2 held by the sliver holding unit 45 is cut. The suction pipe is opened for drawing the silver cut end held by the sliver holding unit 45. The sliver cut end is recovered in the collecting box by the suction function of the collecting box.

The sliver holding unit 45 is then moved by operating the sliver holding arm 31 to the position opposite to the lower end of the old sliver S1. The sliver presser is returned to the standby position. The new sliver S2 is caught by the needles of the sliver piecing unit so as to prevent the new sliver S from dropping from the sliver introduction portion.

When the silver retracting arm 102 is then rotated to the retracted position, the old sliver S1 can engage the sliver holding unit 45. The old sliver S1 is held by the sliver holding unit 45 with the lower end drawn by the suction pipe.

Figure 41:
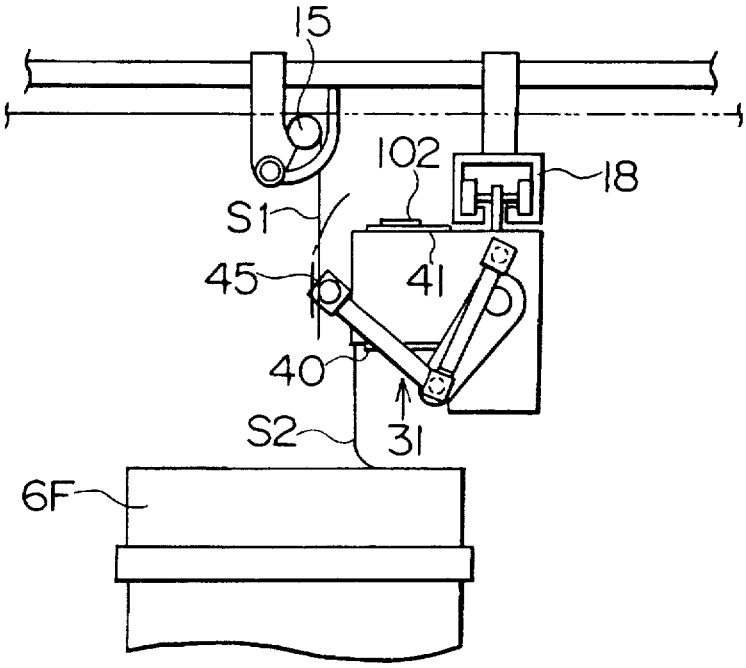
Figure 42:
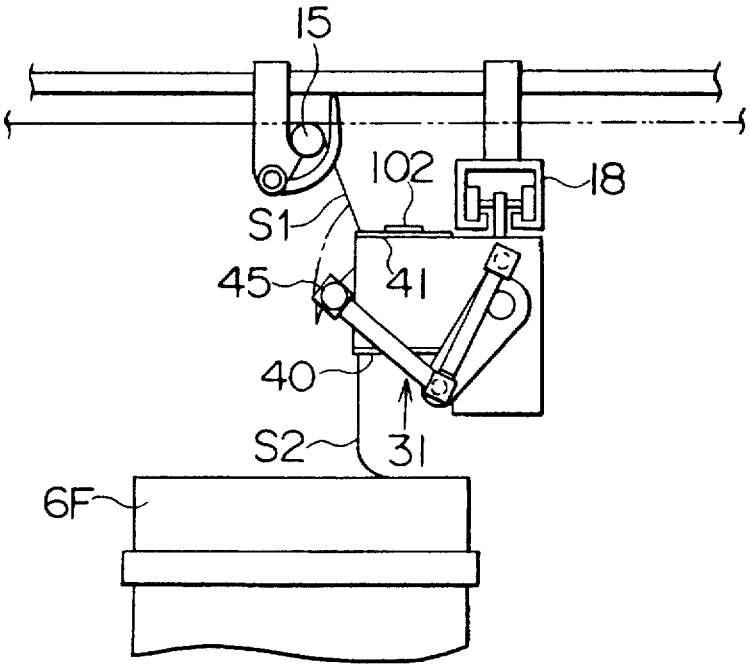
Figure 43:
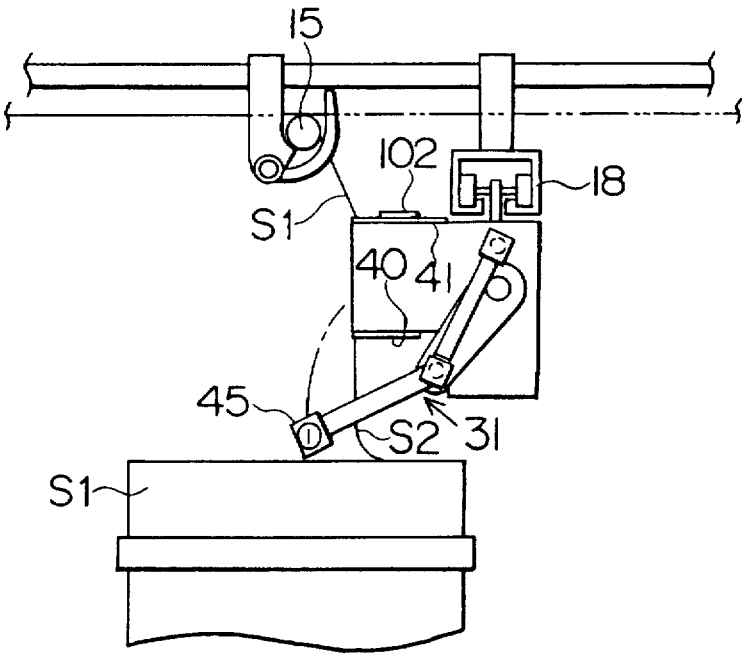
Figure 44:
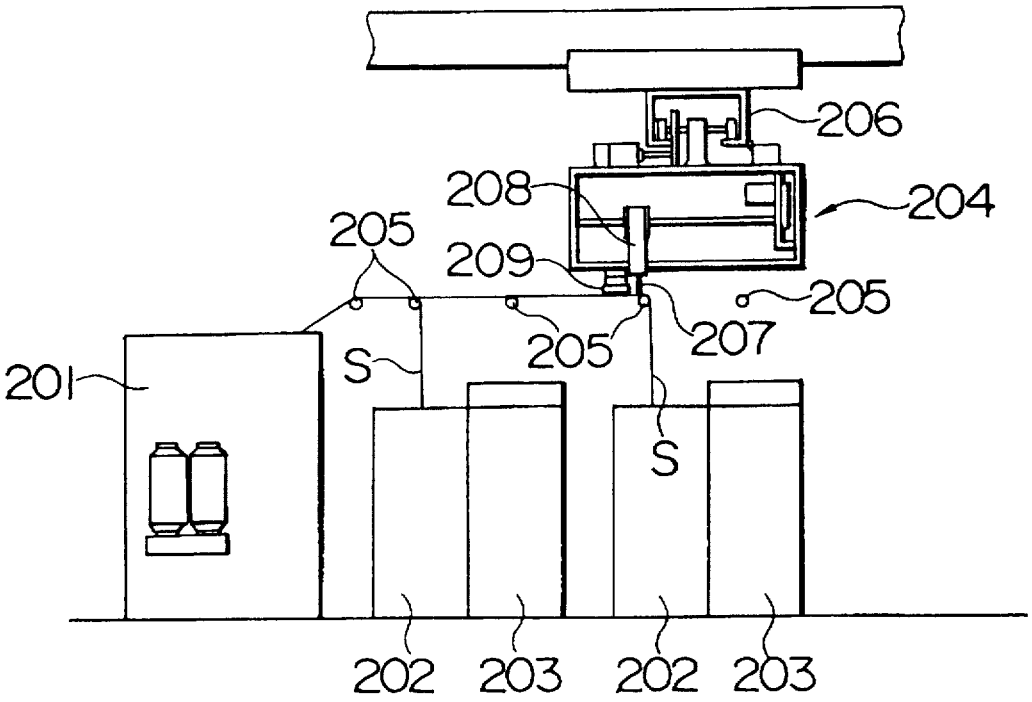
FIG. 44 PRIOR ART
FIG. 44 is a schematic side view illustrating relations among cans, a sliver piecing machine, etc, in a conventional apparatus.

When the sliver taking-in lever 41 provided above the sliver introduction portion is then moved from the retracted position shown in FIG. 41 to the operating position, the old sliver S1 is introduced into the sliver introduction portion (the state shown in FIG. 42). The sliver presser is then again at the operating position so that the old sliver S1 is held by the sliver presser and the sliver piecing unit. In this state, when the sliver holding unit 45 is downwardly moved, as shown in FIG. 43, the old silver S1 held by the silver holding unit 4 is cut between the silver introduction portion and the silver holding unit 45. As a result, the ends of the cut new sliver S2 and the old sliver S1 are overlapped.

In this state, when the sliver piecing unit is operated, the fibers of the slivers S1 and S2 which are overlapped are tangled to join the slivers S1 and S2 together.

Since the new silver S2 is introduced into the sliver introduction portion before the old silver S1 is introduced, as described above, the old sliver S1 does not interfere with the work of cutting the new sliver S2 between the sliver introduction portion and the sliver holding unit 45. The old sliver S1 is neither irregularly drafted nor damaged.

In addition, since the old sliver S1 is maintained at the retracted position by the sliver retracting arm 102 during the time the new sliver S2 is introduced and cut by the sliver holding unit 45, no difficulty is caused in the sliver piecing work.

The supporting arm 58, the first holding lever 71 and the second holding leer 85 of the sliver cutting device 27 may be driven by respective motors in place of the single motor 60, or the first holding lever 31 and the second holding lever 45 may be driven by another driving means such as a cylinder, a solenoid or the like in place of driving by the cam mechanism. The sliver S need not be cut by the method of moving one of the two holding positions, and a cutter may be used for cutting the sliver S.

The sliver holding unit 45 may comprise the suction pipe 46 which is fixedly supported by the second arm **43*b*, and a cylindrical movable holding member which is rotatably provided in the suction pipe 46 and which is driven by the rotary actuator 48. In this case, a connecting piece is provided on the periphery of the movable holding member near the base end thereof so as to project from an elongated hole formed along the periphery of the suction pipe 46, the connecting piece being connected to the lever 49 through the connecting rod 50**.

The sliver piecing machines 20 and 99 and the sliver cutting machine 98 need not be moved on the traveling rails provided above the can rows, and these machines may be moved on the rails provided on the passage for the worker.

As described above, the present invention can decrease the working time from the work of cutting the spun slivers to be pieced with another sliver to the sliver cutting work for one can row.

In the sliver piecing method of the present invention other than the method according to claim 3, the can row from which the sliver was supplied is replaced by the full sliver can row after the slivers under spinning are cut, and the sliver piecing work is then performed.

In the sliver piecing system according to claim 13, since the sliver cutting machine and the sliver piecing machine can separately be moved on the movement paths, each of these machines can be decreased in size, thereby decreasing the limit in providing the movement paths for the sliver cutting machine and the sliver piecing machine under the creel of the roving frame.

What is claimed is:

1. A sliver piecing machine in a spinning machine where the spinning machine has a plurality of spinning units, a row of supply cans each for containing therein a supply of sliver for supplying the spinning units during spinning operation of said spinning machine, a row of new cans each for containing new sliver, and an automatic machine carrying said sliver piecing machine where the sliver piecing machine is constructed to move from one end to the other end of said spinning machine along said row of supply cans, said sliver piecing machine comprising:

a sliver cutting device operative after the spinning operation of said spinning machine is stopped for cutting the supply slivers supplied to the respective spinning units and allowing the end of each cut supply sliver to be suspended toward the associated supply can; and a sliver piecing device for piecing each suspended sliver end with a respective new sliver from within a respective new can;

said sliver cutting device and said sliver piecing device being located on said sliver piecing machine with said sliver cutting device being ahead of said sliver piecing device in the direction of said movement of said sliver piecing machine from said one end to said other end of said spinning machine.

2. A sliver piecing system in a spinning machine having a plurality of spinning units, said system comprising:

a transfer path provided along a row of full sliver cans for supplying slivers to the respective spinning units of the spinning machine and along a row of cans in use from each of which a sliver is connected to a spinning unit;

a sliver cutting machine mounted for movement along said transfer path and equipped with a sliver cutting device for cutting each of the slivers supplied to the spinning units so as to allow the end of each cut sliver, connected to the associated spinning unit, to be temporarily suspended toward an associated supply can; and a sliver piecing machine mounted for movement, independently of and separately from said sliver cutting machine, along said transfer path and equipped with a sliver piecing device for piecing each suspended sliver end with a new sliver from within a respective new can.

3. A sliver piecing machine according to claim 1, wherein said sliver piecing device has sliver holding means comprising suction means.

4. A sliver piecing machine according to claim 3, wherein said sliver cutting device comprises sliver capturing means having a capturing portion which can capture a sliver supplied so as to be freely movable in the lengthwise direction thereof, and holding means which can hold the sliver captured by said capturing portion.

5. A sliver piecing machine according to claim 4, wherein said holding means comprises first and second holding levers for holding a sliver at two separate positions so as to allow the sliver to be cut at a portion thereof between the holding positions.

6. A sliver piecing system according to claim 2, further comprising a can replacement device for replacing empty cans with full cans.

7. A sliver piecing system according to claim 6, wherein said can replacement device comprises at least two longitudinal can conveyance devices extending in parallel with the lengthwise direction of said spinning machine, a transverse can conveyance device disposed in a crossing state near the end of each of said longitudinal can conveyance devices, and a pressure device for pushing out cans from said transverse can conveyance devices to said longitudinal can conveyance devices.

8. A sliver piecing system according to claim 7, wherein said sliver piecing device has a sliver introduction portion for receiving sliver ends to be pieced together.

9. A sliver piecing system according to claim 2, wherein said movement path is a traveling rail comprising a suction duct for drawing the cut sliver end.

10. A sliver piecing method of operating a spinning machine having a plurality of spinning units, a row of supply cans each containing therein a supply sliver for supplying the spinning units during spinning operation of said spinning machine, a row of new cans each containing a new sliver, and an automatic machine including a sliver piecing machine for effecting sliver piecing, said sliver piecing machine being constructed to move from one end to the other end of said spinning machine along said row of supply cans, said sliver piecing method comprising the steps of:

stopping the spinning operation of said spinning machine;

beginning with the spinning unit at one side of said spinning machine, and proceeding successively for each spinning unit to the other side of said spinning machine, cutting the supply slivers at locations between the respective supply cans and the associated spinning units;

allowing the ends of said cut supply slivers that are connected to the respective spinning units to be temporarily suspended toward the associated supply can; and piecing each of said suspended sliver ends with a respective new sliver contained in a respective one of said new cans.